US006629520B2

(12) United States Patent
Inagaki et al.

(10) Patent No.: US 6,629,520 B2
(45) Date of Patent: Oct. 7, 2003

(54) IGNITION APPARATUS FOR INTERNAL COMBUSTION ENGINE

(75) Inventors: Hiroshi Inagaki, Aichi (JP); Daisuke Nakano, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 149 days.

(21) Appl. No.: 09/984,453

(22) Filed: Oct. 30, 2001

(65) Prior Publication Data

US 2002/0056445 A1 May 16, 2002

(30) Foreign Application Priority Data

Oct. 31, 2000 (JP) ..... 2000-332505

(51) Int. Cl.[7] ..... F02P 9/00
(52) U.S. Cl. ..... 123/618; 123/652
(58) Field of Search ..... 123/618, 620, 123/609, 650, 652, 651, 626

(56) References Cited

U.S. PATENT DOCUMENTS 5,220,903 A * 6/1993 Niemetz ..... 123/651
6,526,953 B1 * 3/2003 Inagaki ..... 123/609

FOREIGN PATENT DOCUMENTS

| | | |
|---|---|---|
| EP | 1 063 426 A2 | 12/2000 |
| JP | 2001-193621 | 7/2001 |
| JP | 2001-193622 | 7/2001 |

* cited by examiner

*Primary Examiner*—Mahmoud Gimie
(74) *Attorney, Agent, or Firm*—Sughrue Mion, PLLC

(57) ABSTRACT

In an engine igniter 1, when a spark-discharge duration time Tc calculated on the basis of operation conditions of an internal combustion engine has elapsed after generation of spark discharge by an ignition coil 13, an electricity-supply resumption circuit 51 is operated in order to resume supply of primary current i1 to a primary winding L1, to thereby interrupt the spark discharge. Further, a signal processing control circuit 23 performs electricity-supply-start timing delay control processing in order to delay the timing of supplying electricity to the primary winding L1 in accordance with the power source voltage, to thereby maintain the magnetic flux energy accumulated in the ignition coil 13 at a substantially constant level.

11 Claims, 13 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine in which a spark plug receives high voltage for ignition generated from a secondary winding of an ignition coil upon intermittent supply of primary current to a primary winding thereof, such that the spark plug produces spark discharge in order to burn a fuel-air mixture.

2. Description of the Related Art

Spark energy which an internal combustion engine requires for proper burning of a fuel-air mixture has been known to change depending not only on the type of internal combustion engine, but also on operation conditions such as engine speed and engine load. Spark energy can be represented by the product of the magnitude of discharge current flowing as a result of spark discharge and the duration of the spark discharge.

For example, during low-speed, light-load operation such as idling operation, the amount of fuel-air mixture charged into a combustion chamber is small, and the speed of turbulent flow (swirl flow or tumble flow) of the fuel-air mixture is low. Consequently, combustion of the fuel-air mixture proceeds very slowly. Accordingly, in order to attain stable combustion during low-speed, light-load operation, spark energy must be increased to thereby promote combustion of the fuel-air mixture. Meanwhile, during high-speed, heavy-load operation, the density of the fuel-air mixture charged into the combustion chamber increases, and the speed of turbulent flow of the fuel-air mixture is high, so that the fuel is uniformly agitated. Therefore, sufficient combustion can be attained by means of relatively low spark energy.

In addition, the requisite spark energy varies depending on the air-fuel ratio of the fuel-air mixture. For example, when an internal combustion engine is operated with a lean fuel-air mixture having an air-fuel ratio of 20 or more as in the case of a lean burn engine, the density of fuel is low, and consequently the fuel-air mixture has low ignitability. Therefore, the spark energy must be increased.

In view of the foregoing, a conventional ignition apparatus for an internal combustion engine is designed such that insufficient spark energy does not arise; i.e., the ignition apparatus supplies the maximum spark energy required under various operation conditions of the internal combustion engine.

3. Problems Solved by the Invention

However, the above-described conventional ignition apparatus has the following drawbacks. In a state in which an internal combustion engine can be operated by spark energy lower than the maximum spark energy (e.g., during high-speed, heavy-load operation), supply of spark energy becomes excessive, and the excessive spark energy does not improve the ignitability but accelerates consumption of the spark plug electrodes. In addition, when the internal combustion engine is operated at higher speed or under a heavier load, or at high air-fuel ratio, the speed of turbulent flow of fuel-air mixture increases, and thus, a so-called multiple discharge phenomenon occurs easily. That is, in such a state, spark is caused to flow toward the downstream side during a second half of the spark discharge in which spark energy decreases, the spark discharge is then interrupted, and another spark discharge is generated again. In this manner, multiple discharge occurs. When such a phenomenon occurs, spark concentrates at a downstream point, and electrode temperature increases sharply, thereby accelerating sputtering or melting of electrodes of the spark plug, and only downstream portions of the electrodes are consumed; i.e., so-called local consumption occurs, resulting in shortened service life of the spark plug.

Meanwhile, in recent years, a so-called full-transistor igniter has been widely used for an internal combustion engine. In the full-transistor igniter, a semiconductor device such as a power transistor is used as a switching element for intermittently supplying electricity to a primary winding of an ignition coil in order to apply high voltage for ignition to a spark plug. In such a full-transistor igniter, since the duration of supply of electricity to the primary winding before spark discharge (ignition timing) is controlled (i.e., the drive duration of the switching element is controlled) in accordance with operation conditions of the internal combustion engine, the amount of magnetic flux energy which is accumulated in the ignition coil to be used as spark discharge can be controlled to a level required for combustion of the fuel-air mixture.

However, when the duration of supply of electricity to the primary winding before spark discharge is shortened, the amount of magnetic flux energy which is accumulated in the ignition coil decreases, and consequently the high voltage for ignition generated at the secondary winding through intermittent supply of primary current decreases accordingly. As a result, when electricity-supply duration is controlled in the above-described manner, and the internal combustion engine is operated under conditions, such as high-speed, heavy-load conditions, in which high voltage is required for generation of spark discharge although only a relatively small amount of spark energy is required, the high voltage for ignition generated at the secondary winding decreases and misfire may occur.

In view of the foregoing, as shown in Japanese Patent Application Laid-Open (kokai) No. 11-41717, the present inventors proposed an ignition apparatus for an internal combustion engine which, instead of controlling the duration of supply of electricity to the primary winding of an ignition coil before spark discharge, resumes supply of electricity to the primary winding during spark discharge by use of spark-discharge interruption switching means, to thereby stop spark discharge. When this ignition apparatus for an internal combustion engine is used, it becomes possible to interrupt spark discharge after elapse of a spark discharge duration suitable for operation conditions of the internal combustion engine, while maintaining high voltage for ignition generated at the secondary winding through intermittent supply of electricity to the primary winding. In this manner, the amount of spark energy can be controlled to a proper level.

If the primary current flows continuously after supply of the primary current is resumed for the purpose of interrupting spark discharge, the amount of heat generated by the spark-discharge interruption switching means increases, and power is needlessly consumed. Therefore, the supply of electricity is desirably stopped at a proper timing. However, if the primary current flowing after resumption of electricity supply is stopped abruptly, spark discharge is generated again, thereby impairing operation of the internal combustion engine.

In view of the foregoing, in the ignition apparatus disclosed in Japanese Patent Application Laid-Open No.

11-41717, a capacitive element such as a capacitor is connected in series to the spark-discharge interruption switching means as current adjustment means for decreasing the primary current before stopping the primary current flowing through the primary winding after electricity supply is resumed. Thus, unnecessary generation of spark discharge and needless consumption of power can be suppressed.

In general, in an ignition apparatus for an internal combustion engine, the power source voltage output from a power source unit varies at the time of startup of the internal combustion engine or due to improper operation of a generator, resulting in variations in the amount of magnetic-flux energy accumulated in the ignition coil. That is, when the power source voltage output from the power source unit of the internal combustion engine exceeds its rated value, a larger current flows through the primary winding than in an ordinary state, with the result that an excessive amount of magnetic-flux energy is accumulated in the ignition coil.

Therefore, in the ignition apparatus disclosed in Japanese Patent Application Laid-Open No. 11-41717, if an excessive amount of magnetic-flux energy is accumulated in the ignition coil, an excessive amount of magnetic-flux energy remains in the ignition coil when spark discharge is interrupted, and an excessively large current flows through the spark-discharge interruption switching means. Consequently, the load imposed on the spark-discharge interruption switching means increases, and thus the durability of the spark-discharge interruption switching means is lowered. In addition, an excessive amount of electric charge is accumulated within the capacitor serving as a current adjustment means, and in the worst case, the capacitor may be broken. If the current adjustment means breaks, the flow of primary current caused by resumption of electricity supply is interrupted abruptly, so that spark discharge is generated a plurality of times during a single combustion stroke of the internal combustion engine, resulting in accelerated consumption of the spark plug electrodes. In addition, the reliability of the ignition apparatus may be impaired due to the lowered durability of the spark-discharge interruption switching means.

SUMMARY OF THE INVENTION

The present invention has been accomplished in view of the above-described problems of the prior art. It is therefore an object of the present invention to provide an ignition apparatus for an internal combustion engine which, without controlling the duration of supply of electricity to the primary winding of an ignition coil before spark discharge, minimizes the amount of spark energy supplied to a spark plug to thereby suppress needless consumption of the spark plug and which can prevent breakage of constituent components, which would otherwise occur due to variation in the amount of magnetic-flux energy accumulated in the ignition coil.

The above-object has been achieved in a first aspect of the invention by providing an ignition apparatus for an internal combustion engine comprising: a DC power source unit; an ignition coil having a primary winding through which primary current flows upon application to the primary winding of power source voltage from the DC power source unit, and a secondary winding which forms a closed loop in cooperation with a spark plug attached to the internal combustion engine; switching means connected in series to the primary winding and adapted to interrupt and resume the primary current flowing through the primary winding; and ignition control means for outputting an ignition command signal for controlling ignition timing, the ignition command signal causing the switching means to interrupt and resume the primary current flowing through the primary winding in order to generate at the secondary winding high voltage for ignition to thereby cause the spark plug to generate spark discharge, wherein the ignition apparatus further comprises: spark-discharge duration time setting means for setting a spark-discharge duration time on the basis of operation conditions of the internal combustion engine, the spark-discharge duration time representing a period during which spark discharge of the spark plug is to be maintained; spark-discharge interruption control means for outputting a spark-discharge interruption command signal for controlling the spark-discharge duration time; a spark-discharge interruption circuit for resuming, after generation of spark discharge by the spark plug, supply of the primary current to the primary winding in accordance with the spark-discharge interruption command signal so as to interrupt the spark discharge; and energy control means for maintaining at a substantially constant level magnetic flux energy which accumulates in the ignition coil by supply of electricity to the primary winding by means of the ignition control means.

In the ignition apparatus for an internal combustion engine according to the present invention having the above-described configuration, the spark-discharge duration time setting means sets, on the basis of operation conditions of the internal combustion engine, a spark-discharge duration time necessary for burning a fuel-air mixture; and the spark-discharge interruption control means controls the spark-discharge interruption command signal in accordance with the spark-discharge duration time. The spark-discharge interruption circuit is operated in accordance with the spark-discharge interruption command signal in order to resume supply of primary current to the primary winding to thereby interrupt spark discharge of the spark plug.

That is, the ignition apparatus for an internal combustion engine according to the present invention interrupts spark discharge by resuming the supply of primary current to the primary winding and thus controls spark energy supplied to the spark plug in accordance with operation conditions of the internal combustion engine. It is noted that when the supply of primary current is resumed during spark discharge, the magnetic flux energy which has been decreasing with consumption of the electromotive force generated at the secondary winding is apt to increase, with the result that the ignition coil generates an electromotive force in a direction which maintains decreasing magnetic flux energy decreasing (i.e., a voltage having a polarity opposite that in effect at the time of spark discharge). Thus, spark discharge is interrupted.

In the ignition apparatus for an internal combustion engine according to the present invention, the period for supplying electricity to the primary winding before spark discharge is set long in order to accumulate sufficient magnetic flux energy in the ignition coil. Therefore, a high voltage can be generated at the secondary winding for ignition which has a magnitude sufficient for generating spark discharge reliably under any operation condition of the internal combustion engine. In addition, since the spark-discharge duration time is controlled in accordance with operation conditions of the internal combustion engine, supply of excessive spark energy to the spark plug can be prevented.

When the internal combustion engine is operated under conditions, such as high-speed, heavy-load conditions, in which only a relatively small amount of spark energy is required, the spark-discharge duration time is shortened in order to cause the spark plug to reliably generate spark discharge through application of high voltage for ignition thereto, while suppressing excessive supply of spark energy to the spark plug to thereby suppress generation of multiple discharge. In contrast, when the internal combustion engine is operated under conditions, such as low-speed, light-load conditions, in which ignition of fuel-air mixture is difficult, the spark-discharge duration time is increased in order to reliably burn the fuel-air mixture. That is, since the spark-discharge duration time is controlled optimally on the basis of operation conditions of the internal combustion engine, generation of multiple discharge and consumption of the spark plug electrodes are suppressed to thereby extend the service life of the spark plug. In addition, occurrence of misfire can be suppressed.

In the ignition apparatus for an internal combustion engine according to the present invention, when spark discharge of the spark plug is to be interrupted, the spark-discharge interruption circuit is operated in accordance with the spark-discharge interruption command signal for controlling the spark-discharge duration time. As described in a second aspect of the invention, the spark-discharge interruption circuit may include an electricity-supply resumption circuit connected in parallel to the switching means adapted to interrupt and resume the primary current flowing through the primary winding. The electricity-supply resumption circuit includes spark-discharge interruption switching means for resuming supply of the primary current to the primary winding in accordance with the spark-discharge interruption command signal; and current adjustment means connected in series to the spark-discharge interruption switching means and adapted to reduce the primary current flowing through the primary winding, after resumption of supply of the primary current to the primary winding, so as to prevent the spark plug from generating spark discharge.

As described above, when spark discharge of the spark plug is to be interrupted, the spark-discharge interruption switching means of the electricity-supply resumption circuit is driven in accordance with the spark-discharge interruption command signal, to thereby resume the supply of electricity to the primary winding. The primary current which flows through the primary winding upon resumption of electricity supply is not interrupted instantaneously, but is decreased gradually by the current adjustment means of the electricity-supply resumption circuit such that the spark plug does not generate spark discharge. That is, after the supply of electricity to the primary winding is resumed so as to interrupt spark discharge of the spark plug, the current adjustment means gradually reduces the primary current which flows upon resumption of electricity supply, to thereby prevent generation of high voltage at the secondary winding when the resumed electricity supply is stopped.

Notably, instead of using the above-described electricity-supply resumption circuit, the spark-discharge interruption circuit may be configured such that a switching element such as a thyristor or a mechanical relay is connected to the opposite ends of the primary winding in parallel thereto, and the opposite ends of the primary winding are short-circuited by means of the switching element.

Further, in the ignition apparatus for an internal combustion engine according to the present invention, the energy control means maintains at a substantially constant level the magnetic flux energy which is accumulated in the ignition coil by virtue of supply of electricity to the primary winding by means of the ignition control means. Therefore, even when the magnetic flux energy accumulated in the ignition coil changes, mainly due to variation in the power source voltage, the magnetic flux energy accumulated in the ignition coil is controlled at a substantially constant level by the energy control means. As a result, the constituent elements, such as spark-discharge interruption switching means, of the spark-discharge interruption circuit are not broken. Also, their durability is not deteriorated, which breakage or durability deterioration would otherwise occur due to accumulation of excess magnetic flux energy in the ignition coil at the time that the spark discharge is interrupted. Therefore, the reliability of the ignition apparatus can be enhanced.

Therefore, in the ignition apparatus for an internal combustion engine according to the first aspect of the present invention, since the spark energy supplied to the spark plug is controlled by interrupting spark discharge performed on the basis of operation conditions of the internal combustion engine, useless consumption of the electrodes of the spark plug can be suppressed. In addition, since excessive magnetic flux energy is not accumulated in the ignition coil at the time of electricity being supplied to the primary winding by means of the ignition control means, problems such as breakage of a constituent element of the spark-discharge interruption circuit for interrupting spark discharge can be prevented. Through combined use of the energy control means and the spark-discharge interruption circuit, which operates in accordance with the spark-discharge interruption command signal, influence of variation in the magnetic flux energy accumulated in the ignition coil is suppressed in order to enable more reliable performance of the operation of interrupting spark discharge of the spark plug on the basis of operation conditions of the internal combustion engine, to thereby improve the reliability of the ignition apparatus.

In the ignition apparatus for an internal combustion engine according to a third aspect of the present invention, the energy control means for maintaining the magnetic flux energy accumulated in the ignition coil at a substantially constant level may include electricity-supply-start timing delay means for detecting power source voltage output from the DC power source unit, for setting, on the basis of the power source voltage, an electricity-supply-start delay time representing a time by which start of supply of electricity to the primary winding is to be delayed, and for delaying by the electricity-supply-start delay time the timing at which the ignition control means starts supply of electricity to the primary winding. That is, in the ignition apparatus for an internal combustion engine according to the present invention, the energy control means is configured such that the supply of electricity to the primary winding is not simply started in response to an ignition command signal which is output in accordance with operation conditions of the internal combustion engine, but the timing for starting supply of electricity to the primary winding before spark discharge is delayed in accordance with the power source voltage output from the DC power source unit.

Such electricity-supply-start timing delay means may be realized by means of a circuit configuration which can maintain the switching means in an OFF state irrespective of control of the ignition command signal by the ignition control means; e.g., a circuit configuration which can change or maintain the ignition command signal input to the switching means in a state which brings the switching means into an OFF state. Until the electricity-supply-start delay time has elapsed after an ignition command signal is output from the ignition control means in order to bring the switching means into an ON state, the electricity-supply-start timing delay means forcedly changes the state of the ignition command signal such that the switching means comes into an OFF state. Thus, the ignition command signal whose state has been changed by the electricity-supply-start timing delay means is input to the switching means, and consequently the ignition control means becomes unable to control the switching means. As result, supply of electricity to the primary winding is not started at the electricity-supply-start timing instructed by the ignition control means.

When the electricity-supply-start timing delay means stops the forced control of the ignition command signal input to the switching means after elapse of the electricity-supply-start delay time, the ignition control means becomes able to control the switching means, and thus, the switching means comes into an ON state by virtue of control by the ignition control means. As a result, supply of electricity to the primary winding is started. The above-described operation enables delay of the timing of starting the supply of electricity until the electricity-supply-start delay time elapses from the electricity-supply-start timing determined by the ignition control means.

Since the electricity-supply-start timing delay means sets the electricity-supply-start delay time in accordance with the power source voltage, even when the power source voltage varies, the magnetic flux energy accumulated in the ignition coil can be maintained at a substantially constant level.

Notably, the electricity-supply-start delay time is preferably set such that the electricity-supply-start delay time increases with the power source voltage. Notably, the electricity-supply-start timing delay means controls only timing for starting supply of electricity to the primary winding and does not change the timing of interrupting the primary current (i.e., ignition timing), and the ignition timing is determined by the ignition control means. Therefore, provision of the electricity-supply-start timing delay means exerts no influence on the ignition timing.

Incidentally, the ignition control means is typically realized by means of the internal processing of a main controller (ECU), which is constituted by a microcomputer mainly consisting of a CPU, RAM, ROM and an input/output section. A recent main controller provided on an internal combustion engine controls not only ignition but also many other items, such as fuel injection amount, air-fuel ratio, and fuel injection timing, on the basis of signals input from sensors (e.g., crank angle sensor) provided at different portions of the internal combustion engine. Therefore, the load imposed on the internal processing of the main controller has increased considerably.

Therefore, when the main controller performs, in addition to various existing control processes, a series of processes for interrupting spark discharge and a process for delaying the timing of starting supply of electricity to the primary winding, the processing load may increase, with the result that the main controller becomes unable to perform the various control processes properly.

In particular, in the case of an internal combustion engine having a large number of cylinders, since the number of control processes to be performed individually for each cylinder increases, the processing load increases further.

When the above-described ignition apparatus of the third aspect of the invention is used for an internal combustion engine having a plurality of cylinders, as described in a fourth aspect of the invention, the ignition coil, the switching means, and the spark-discharge interruption circuit are provided for each of the spark plugs attached to the respective cylinders. The ignition control means comprises a main controller including the spark-discharge duration time setting means; and a signal processing unit including the electricity-supply-start timing delay means and the spark-discharge interruption control means. The main controller sets an ignition timing and a spark-discharge duration time for each cylinder on the basis of operation conditions of the internal combustion engine, and generates a reference ignition command signal corresponding to the ignition timing. The signal processing unit receives the reference ignition command signal output from the main controller and outputs to the switching means an ignition command signal which is delayed from the reference ignition command signal by the electricity-supply-start delay time, and generates, on the basis of the spark-discharge duration time set by the main controller, a spark-discharge interruption command signal to be output to the spark-discharge interruption circuit.

That is, the processing for generating the reference ignition command signal on the basis of operation conditions of the internal combustion engine is performed in the main controller; and the processing for controlling the ignition command signal which is output to the switching means on the basis of the reference ignition command signal is performed in the signal processing unit. Thus, the processing necessary for generation of spark discharge is effected in order to generate spark discharge.

Further, the processing for setting the spark-discharge duration time is performed in the main controller; and the processing for controlling the spark-discharge interruption circuit is performed in the signal processing unit. Thus, the processing for interrupting spark discharge is performed in order to control energy supplied to the spark plug.

Since the processing for generating spark discharge and the processing for interrupting spark discharge are executed while being distributed between the main controller and the signal processing unit, an increase in the processing load of the main controller is suppressed.

Moreover, the processing for delaying the timing of starting the supply of electricity to the primary winding in accordance with variation of the power source voltage is performed in the signal processing unit in order to maintain at a substantially constant level the magnetic flux energy accumulated in the ignition coil. This protects the constituent elements of the spark-discharge interruption circuit, while suppressing an increase in the processing load of the main controller.

Therefore, in the fourth aspect of the present invention, since the processing for generating spark discharge and the processing for interrupting spark discharge are executed while being distributed between the main controller and the signal processing unit, an increase in the processing load of the main controller is suppressed, and various types of control processing can be executed properly in the main controller.

Notably, in order to delay the timing of starting the supply of primary current, the signal processing unit may include a signal path for outputting the reference ignition command signal directly to the switching means as an ignition command signal; and signal interruption means for breaking or disconnecting, if necessary, the signal path for outputting the reference ignition command signal directly to the switching means. That is, when the signal path is broken or disconnected by means of the signal interruption means, the ignition command signal is not output in accordance with the reference ignition command signal. The signal path is connected again upon elapse of the electricity-supply-start delay time from the time at which the supply of electricity is instructed by the reference ignition command signal. Thus, the timing of starting the supply of electricity to the primary winding can be delayed.

If such a signal processing unit is employed, even when the signal processing unit does not operate properly due to a certain cause, the signal path is maintained in a connected state; consequently, the switching means can be controlled directly in accordance with the reference ignition command signal from the main controller. Therefore, at least generation of spark discharge can be effected in order to continue the operation of the internal combustion engine.

When processing is executed while being distributed between the main controller and the signal processing unit, wire lines (signal paths) for sending the reference ignition command signal and the spark-discharge duration time from the main controller to the signal processing unit must be provided. However, in order to increase the packaging efficiencies of the main controller and the signal processing unit, the number of input terminals or output terminals is desirably decreased in order to reduce occupation areas.

In view of the foregoing, a configuration as described in a fifth aspect of the invention is preferably employed in order to communicate to the signal processing unit the spark-discharge duration time set by the main controller. That is, in order to communicate to the signal processing unit the spark-discharge duration time set by the spark-discharge duration time setting means, while maintaining the form of a portion of the reference ignition command signal used to communicate an ignition timing, the main controller changes the form of another portion of the reference ignition command signal in order to include information representing the spark-discharge duration time; and the signal processing unit reads the spark-discharge duration time from the reference ignition command signal output from the main controller and generates the spark-discharge interruption command signal on the basis of the spark-discharge duration time.

That is, only a signal path for sending a reference ignition command signal is provided between the main controller and the signal processing unit; and the form of the reference ignition command signal is changed in order to include information representing the spark-discharge duration time, to thereby communicate from the main controller to the signal processing unit the spark-discharge duration time, as well as the ignition timing. Since the form of the portion of the reference ignition command signal used for communicating an ignition timing is maintained, even when the form of reference ignition command signal is changed in order to communicate the spark-discharge duration time, an erroneous ignition timing is not communicated to the signal processing unit.

Since provision of a wiring line for communicating the spark-discharge duration time between the main controller and the signal processing unit is not required, the number of input or output terminals can be reduced in order to simplify the structure of the ignition apparatus.

In the case in which the reference ignition command signal is output as a pulse signal which represents an ignition timing and a primary-current supply period before spark discharge, the form of the reference ignition command signal is preferably changed such that the pulse width of the pulse signal is changed so as to communicate the spark-discharge duration time. That is, the spark-discharge duration time is communicated from the main controller to the signal processing unit by use of a notification reference ignition command signal having a pulse width different from that of the ordinary reference ignition command signal.

A rule for defining the relationship between the spark-discharge duration time and the number of continuously-output notification reference ignition command signals or the relationship between the spark-discharge duration time and the pulse width of a notification reference ignition command signal is determined in advance; and the main controller communicates the spark-discharge duration time to the signal processing unit by use of the notification reference ignition command signal(s) and in accordance with the rule.

In the signal processing unit, the spark-discharge interruption control means detects the spark-discharge duration time from the number of continuously-output notification reference ignition command signals or the pulse width of the notification reference ignition command signal. Subsequently, the spark-discharge interruption control means interrupts spark discharge when the spark-discharge duration time has elapsed after generation of spark discharge.

Therefore, the ignition apparatus for an internal combustion engine according to a fifth aspect of the present invention eliminates the necessity of providing a wiring line between the main controller and the signal processing unit in order to communicate the spark-discharge duration time only. Thus, the structure of the ignition apparatus can be simplified, and packaging efficiency can be improved.

Since the pulse width of the notification reference ignition command signal corresponds to the primary-current supply period before spark discharge, generation of spark discharge may become difficult if the pulse width of the notification reference ignition command signal is excessively narrow. Therefore, the pulse width of the notification reference ignition command signal is preferably set wider than the narrowest pulse width necessary for generation of spark discharge.

Incidentally, in the case of an internal combustion engine having a plurality of cylinders, pistons accommodated in the respective cylinders are connected to a common crank shaft and cause reciprocating motion, and therefore, the sequence of spark-discharge generation timings (i.e., ignition timings) of the respective cylinders is constant. Since the sequence of ignition timings of the plurality of cylinders is fixed, the internal combustion engine can be operated when the spark plugs provided for the respective cylinders are caused to generate spark discharge in a predetermined sequence, one spark plug at a time, every time a signal representing the ignition timings of all the cylinders is output after detection of the ignition timing of a certain cylinder.

In view of the above, as described in a sixth aspect of the invention, the signal processing unit of the ignition apparatus provided for an internal combustion engine having a plurality of cylinder preferably comprises: signal processing control means for executing at least the processing of the spark-discharge interruption control means and the processing of the electricity-supply-start timing delay means; a first signal path for supplying to the signal processing control means at least one of the reference ignition command signals for the respective cylinders output from the main controller; and a second signal path for supplying to the signal processing control means a synthesized ignition command signal obtained through synthesis of all the reference ignition command signals output from the main controller, wherein the signal processing control means uses, as a reference, a time at which the reference ignition command signal is input from the first signal path, and outputs ignition command signals for the respective cylinders in a predetermined sequence such that one ignition command signal is output every time the synthesized ignition command signal is input from the second signal path.

That is, the signal processing control means of the signal processing unit receives, via the first signal path, a reference ignition command signal used for identifying the ignition timing of a certain cylinder, and receives, via the second signal path, a synthesized ignition command signal which represents the ignition timings of all the cylinders.

Therefore, the signal processing control means can use, as a reference, the reference ignition command signal for the predetermined single cylinder, and output ignition command signals for the respective cylinders in a predetermined sequence such that one ignition command signal is output every time the synthesized ignition command signal is input. Thus, spark discharge can be generated at a proper timing in each cylinder to thereby operate the internal combustion engine.

Since inputting all the reference ignition command signals to the signal processing unit becomes unnecessary, in the case of an internal combustion engine having three or more cylinders, ignition command signals for the respective cylinders can be output at proper timings even when the number of input terminals of the signal processing control means; i.e., the number of input terminals for inputting the reference ignition command signals, is less than the number of the cylinders of the internal combustion engine.

Therefore, the ignition apparatus for an internal combustion engine according to the sixth aspect of the present invention can reduce the number of input terminals of the signal processing control means provided in the signal processing unit, to thereby increase the packaging density of the signal processing control means.

Notably, the synthesized ignition command signal is preferably obtained through logical addition (OR) of all the reference ignition command signals such that the synthesized ignition command signal enters an ON state when at least one of the reference ignition command signals enters an ON state.

Incidentally, the above-described ignition apparatus for an internal combustion engine (any one of the first through sixth aspects of the invention) achieves the effect more remarkably when the ignition apparatus is used for a gas engine using a gaseous fuel as described in a seventh aspect of the invention.

That is, since gaseous fuel has a higher insulating resistance than does liquid fuel (e.g., gasoline), in order to reliably ignite fuel in a gas engine, ignition voltage higher than that for gasoline engines must be generated in order to generate strong spark discharge. Accordingly, an ignition coil for a gas engine using a gaseous fuel must be designed such that the ignition coil generates a maximum secondary voltage (high voltage for ignition) higher than that for gasoline engines (e.g., whereas the maximum secondary voltage of an ignition coil for a gasoline engine is 30 kV or higher, the maximum secondary voltage of an ignition coil for a gasoline engine is 40 kV or higher).

Therefore, in the case of a gas engine, the magnitude of current which is intermittently supplied to the primary winding of an ignition coil is set relatively high. Therefore, conceivably, a large amount of unnecessary spark energy may be supplied to the spark plug, to thereby further shorten the service life of the spark plug.

In the case of a gas engine, when the power source voltage increases, the primary current flowing through the primary winding increases further, and the current flowing through a transistor serving as the switching means increases further. In this case, the heat generation of the transistor increases, and the transistor may burn out. Therefore, when the above-described ignition apparatus of the present invention is used for a gas engine in order to maintain the magnetic flux energy accumulated in the ignition coil at a substantially constant level, excessive current does not flow through the transistor over a long period of time, whereby excessive heat generation of the transistor serving as the switching means can be prevented.

In the case in which the ignition apparatus according to any one of the first through sixth aspects of the invention is applied to a gas engine as described in the seventh aspect of the invention, an effect of preventing excessive heat generation of the switching means due to variation in the magnetic flux energy accumulated in the ignition coil can be obtained.

In some ignition apparatuses used for stationary gas engines, AC voltage (e.g., 100 or 200 V) supplied from a commercial power source such as an electric power company is converted to DC voltage by use of a transformer, a rectifier, a smoothing circuit, etc.; and the thus-obtained DC voltage is used to generate current to be supplied to the primary winding, to thereby generate high voltage for ignition.

In the case of an ignition apparatus used for a stationary gas engine which uses a commercial power source, voltage applied to the primary winding of the ignition coil is apt to change, with the possible result that the switching means generates excessive heat and bums out. That is, the demand for electric power supplied from an electric power company changes seasonally, and the magnitude of the AC voltage supplied from the commercial power source changes due to variation in the demand for power among seasons (e.g., between summer and winter). Notably, the AC voltage supplied from the commercial power source changes within a predetermined tolerance range.

Since the AC voltage supplied from the commercial power source such as an electric power company changes within the tolerance range, the magnitude of DC voltage obtained from the AC voltage also changes seasonally. Therefore, in the case of a stationary gas engine, the power source voltage used for generating current to be supplied to the primary winding changes seasonally.

As described above, in the case of a gas engine, since the period for supplying primary current is determined in consideration of a case in which the ignitability of fuel is at its poorest level, the period for supplying primary current is determined on the basis of the magnitude of DC voltage in a season in which the magnitude of DC voltage becomes lowest (i.e., primary current becomes smallest). In this case, during seasons in which the magnitude of DC voltage increases, the primary current becomes excessive even when the primary-current supply period is controlled properly, thereby increasing the possibility of the switching means generating excessive heat.

Accordingly, when the above-described ignition apparatus is applied to a stationary gas engine, the effects of the present invention can be achieved more remarkably. That is, since the magnetic flux energy accumulated in the ignition coil is maintained at a substantially constant level, it is possible to prevent excessive current from flowing through a transistor for a long period, to thereby protect the switching means.

DESCRIPTION OF REFERENCE NUMERALS

Figure 1:
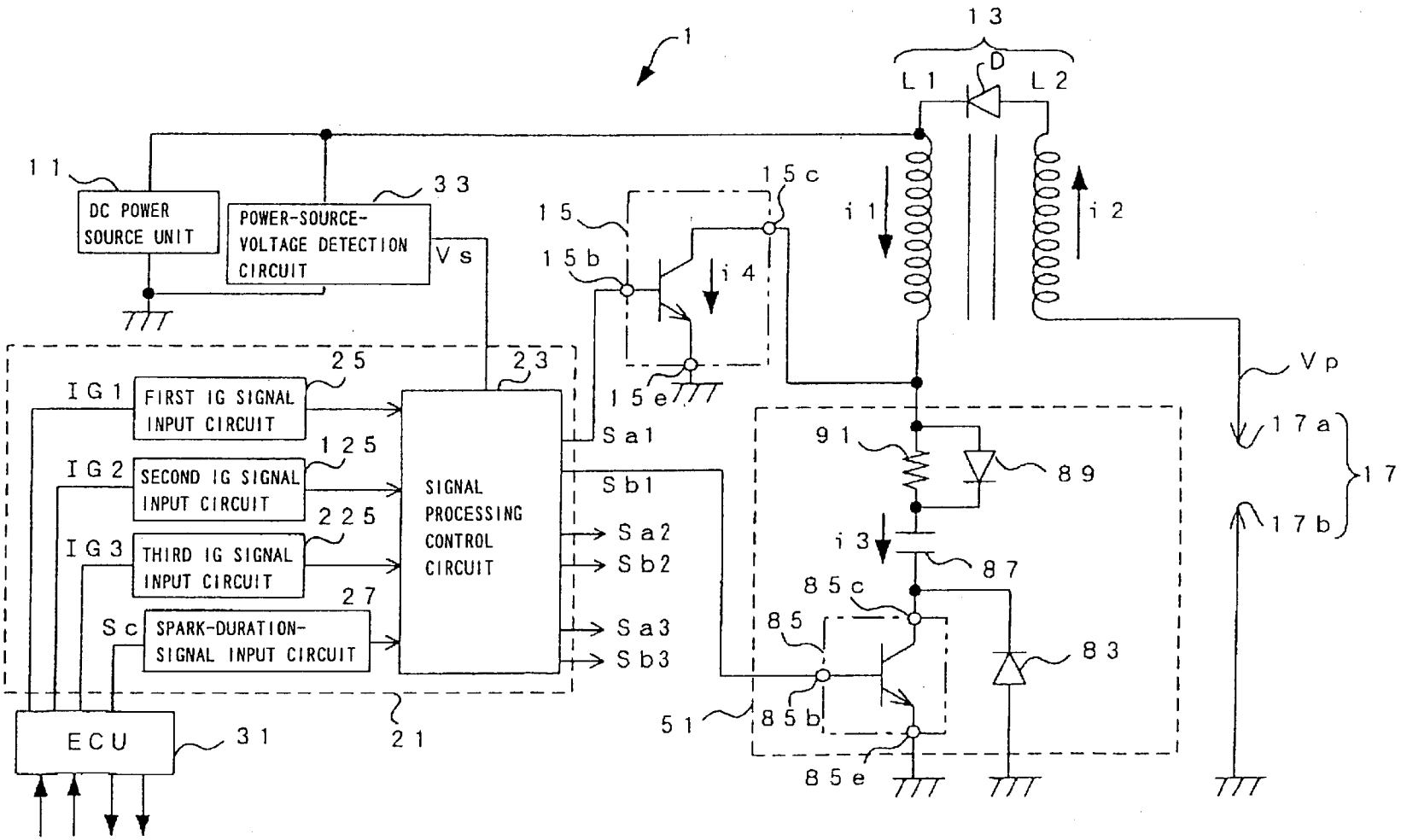
FIG. 1 is a diagram showing the configuration of a portion of an engine igniter according to a first embodiment of the invention corresponding to the first cylinder.

1 . . . engine igniter
11 . . . DC power source unit
13 . . . ignition coil
15 . . . main control transistor
17 . . . spark plug
21 . . . signal processing unit
23 . . . signal processing control circuit
25 . . . first IG signal input circuit
27 . . . spark-duration-signal input circuit
29 . . . IG signal synthesis circuit
31 . . . electronic control unit (ECU)
33 . . . power-source-voltage detection circuit
51 . . . electricity-supply resumption circuit

DETAILED DESCRIPTION OF THE PREFERRED EMBODIMENTS

Embodiments of the present invention will now be described with reference to the drawings. However, the present invention should not be construed as being limited thereto FIG. 1 is a diagram schematically showing the configuration of an ignition apparatus for an internal combustion engine (hereinafter also referred to as an "engine igniter") according to one embodiment of the invention. The engine igniter according to the present embodiment is an engine igniter for a stationary gas engine which uses gaseous fuel. This stationary gas engine has three cylinders.

As shown in FIG. 1, the engine igniter 1 according to the present embodiment includes a DC power source unit 11, which converts AC voltage from a commercial power source to DC voltage (e.g., 12 V) for spark discharge and outputs the DC voltage; an ignition coil 13, which has a primary winding L1 and a secondary winding L2; a main control transistor 15, which is an npn-type transistor connected in series to the primary winding L1; a spark plug 17, which forms a closed loop in cooperation with the secondary winding L2 and generates spark discharge between a center electrode 17*a* and a ground electrode 17*b*; an electricity-supply resumption circuit 51, which resumes supply of primary current to the primary winding L1 so as to interrupt spark discharge generated by the spark plug 17; a signal processing unit 21, which outputs an ignition command signal to the main control transistor 15 in order to cause the spark plug 17 to generate spark discharge and also outputs a spark-discharge interruption command signal to the electricity-supply resumption circuit 51 in order to interrupt spark discharge; an electronic control unit (hereinafter referred to as an "ECU") 31 for controlling an internal combustion engine, which outputs a reference ignition command signal and a spark duration signal to the signal processing unit 21 in accordance with operation conditions of the internal combustion engine; and a power-source-voltage detection circuit 33, which detects power source voltage output from the DC power source unit 11.

Of the above-described components, the main control transistor 15 serves as a semiconductor switching element for intermittently supplying electricity to the primary winding L1 of the ignition coil 13. The engine igniter 1 of the present embodiment is a completely solid state transistor engine igniter.

Although each cylinder is provided with the above-described components of the engine igniter 1 of the present embodiment, other than the DC power source unit 11, the power-source-voltage detection circuit 33, the signal processing unit 21, and the ECU 31, in order to facilitate understanding, FIG. 1 shows only the structural components for the first cylinder.

The ECU 31 shown in FIG. 1 controls the spark-discharge generation timing (ignition timing), fuel injection amount, engine speed, and other parameters of the internal combustion engine on the basis of operation conditions of the internal combustion engine. The ECU 31 is constituted by a microcomputer, which mainly consists of a CPU, RAM, ROM and an input/output section. The ECU 31 outputs to the signal processing unit 21 a first reference ignition command signal IG1 for the first cylinder, a second reference ignition command signal IG2 for the second cylinder, a third reference ignition command signal IG3 for the third cylinder, and a spark duration signal Sc which represents a spark-discharge duration time common among all the cylinders.

The signal processing unit 21 includes a signal processing control circuit 23, which is constituted by a microcomputer driven by power supplied from a constant-voltage power source which outputs constant voltage (e.g., 5 V); a first IG signal input circuit 25, a second IG signal input circuit 125, and a third IG signal input circuit 225, which form signal paths for respectively inputting the first through third reference ignition command signals IG1–IG3 to the signal processing control circuit 23; and a spark-duration-signal input circuit 27, which forms a signal path for inputting the spark duration signal Sc to the signal processing control circuit 23.

The signal processing control circuit 23 of the signal processing unit 21 outputs a first ignition command signal Sa1 to the main control transistor 15 corresponding to the first cylinder, and also outputs second and third ignition command signals Sa2 and Sa3 to respective main control transistors corresponding to the second and third cylinders. Further, the signal processing control circuit 23 outputs a first spark-discharge interruption command signal Sb1 to the electricity-supply resumption circuit 51 corresponding to the first cylinder, and also outputs second and third spark-discharge interruption command signals Sb2 and Sb3 to respective electricity-supply resumption circuits corresponding to the second and third cylinders.

The DC power source unit 11 includes a transformer, a rectifier, a smoothing circuit, and other components. The DC power source unit 11 transforms an AC voltage (e.g., AC 100 V) from a commercial power source to a lower AC voltage, rectifies the lower AC voltage to obtain a rectified voltage, and smoothes the rectified voltage to thereby obtain a DC voltage (e.g., 12 V).

The power-source-voltage detection circuit 33 is constructed by two resistors connected in series. A divided voltage Vs, which is a fraction of the power source voltage obtained by the resistors (i.e., Vs is the electrical potential at the node between the two resistors) is output to the signal processing unit 21 (specifically, to the signal processing control circuit 23). Notably, the resistances of the two resistors provided in the power-source-voltage detection circuit 33 are determined such that the range of variation of the divided voltage Vs corresponding to the range of variation of the power source voltage output from the DC power source unit 11 falls within an allowable range of voltage input to the input terminal of the signal processing control circuit 23. Thus, the divided voltage Vs varies between the lower limit and upper limit of the input range (e.g., 0 to 5 V) of the signal processing control circuit 23 in accordance with the value of the power source voltage.

Therefore, the signal processing control circuit 23 can detect the power source voltage by multiplying the divided voltage Vs input thereto by the ratio of the power source voltage to the divided voltage Vs, which is determined by the respective resistances of the two resistors provided in the power-source-voltage detection circuit 33.

In accordance with the power source voltage detected on the basis of the divided voltage Vs, the signal processing control circuit 23 sets an electricity-supply-start delay time. When the electricity-supply-start delay time elapses after the level of the first reference ignition command signal IG1 has become high, the signal processing control circuit 23 changes the level of the first ignition command signal Sa1 to high in order to drive the main control transistor 15, to thereby start supply of electricity to the primary winding L1.

The details of electricity-supply-start timing delay control processing performed by the signal processing control circuit 23 will be described below.

Next, the ignition coil 13, the main control transistor 15, the spark plug 17, and the electricity-supply resumption circuit 51 will be described, which are shown in FIG. 1 and provided for the first cylinder.

One end of the primary winding L1 of the ignition coil 13 is connected to the positive terminal of the DC power source unit 11, and the other end of the primary winding L1 is connected to the collector 15*c* of the main control transistor 15. One end of the secondary winding L2 is connected via a rectifying element D to the one end of the primary winding L1, which is connected to the positive terminal of the DC power source unit 11, and the other end of the secondary winding L2 is connected to the center electrode 17*a* of the spark plug 17. Further, the ground electrode 17*b* of the spark plug 17 is connected to ground, which has the same potential as that of the negative terminal of the DC power source unit 11. The base 15*b* of the main control transistor 15 is connected to an output terminal of the signal processing control circuit 23 from which the first ignition command signal Sa1 is output. The emitter 15*e* of the main control transistor 15 is connected to ground, which has the same potential as that of the negative terminal of the DC power source unit 11.

When the first ignition command signal Sa1 input to the base 15*b* of the main control transistor 15 is at a low level (typically, the ground potential), no base current flows in the main control transistor 15, and consequently, the main control transistor 15 enters an OFF state. In this case, primary current i1 does not flow through the primary winding L1 via the main control transistor 15. When the first ignition command signal Sa1 is at a high level (e.g., voltage (5 V) supplied from the constant voltage power source), the main control transistor 15 enters an ON state. In this case, a path for supplying electricity to the primary winding L1 of the ignition coil 13 is formed. That is, a path is formed which starts from the positive terminal of the DC power source unit 11, passes through the primary winding L1 of the ignition coil 13 and the main control transistor 15, and reaches the negative terminal of the DC power source unit 11. Thus, primary current i1 flows through the primary winding L1.

Accordingly, when the level of the first ignition command signal Sa1 becomes low in a state in which primary current i1 is flowing through the primary winding L1 by virtue of the first ignition command signal Sa1 having been of high level, the main control transistor 15 turns off to thereby stop (interrupt) supply of the primary current i1 to the primary winding L1. As a result, the magnetic flux density of the ignition coil 13 changes abruptly, and thus high voltage for ignition is generated from the secondary winding L2. Upon application to the spark plug 17 of the high voltage for ignition, spark discharge is generated between the electrodes 17*a* and 17*b* of the spark plug 17.

The ignition coil 13 is configured such that when primary current i1 is intermittently supplied to the primary winding L1 via the main control transistor 15, high voltage for ignition which is negative relative to the ground potential is generated at the center electrode 17*a* of the spark plug 17. Upon generation of spark discharge at the spark plug 17, secondary current i2 flows from the center electrode 17*a* of the spark plug 17 toward the primary winding L1 side via the secondary winding L2. Further, the rectifying element D, such as a diode, is provided at the connection portion between the secondary winding L2 and the primary winding L1 in order to permit flow of current from the secondary winding L2 toward the primary winding L1 and prevent flow of current in the opposite direction. In the present embodiment, a diode serving as the rectifying element D is provided such that the anode of the diode is connected to the secondary winding L2 and the cathode of the diode is connected o the primary winding L1. The action of the rectifying element D prevents current from flowing into the secondary winding L2, which flow would otherwise occur when the main control transistor 15 is turned on (when supply of electricity to the primary winding L1 is started).

The electricity-supply resumption circuit 51 includes an npn-type transistor 85. The emitter 85*e* of the transistor 85 is grounded. The base 85*b* of the transistor 85 is connected to a terminal of the signal processing control circuit 23 from which the first spark-discharge interruption command signal Sb1 is output. The collector 85*c* of the transistor 85 is connected to one connection end (electrode) of a capacitor 87 and is grounded via a diode 83. The anode of the diode 83 is grounded, and the cathode of the diode 83 is connected to the collector 85*c* of the transistor 85. A connection end (electrode) of the capacitor 87 opposite the connection end (electrode) connected to the transistor 85 is connected via a resistor 91 to a node via which the collector 15*c* of the main control transistor 15 is connected to the primary winding L1. Further, a diode 89 is connected in parallel to the resistor 91. The anode of the diode 89 is connected to a line extending between the resistor 91 and the primary winding L1, and the cathode of the diode 89 is connected to a line extending between the resistor 91 and the capacitor 87.

When the first spark-discharge interruption command signal Sb1 output from the signal processing control circuit 23 is at a low level, the transistor 85 in the electricity-supply resumption circuit 51 enters an OFF state, and consequently, the electricity-supply resumption circuit 51 does not cause primary current i1 to flow from the positive terminal of the DC power source unit 11 toward the primary winding L1.

When the first spark-discharge interruption command signal Sb1 is at a high level, the transistor 85 in the electricity-supply resumption circuit 51 enters an ON state, and consequently, the electricity-supply resumption circuit 51 forms a path for supplying electricity to the primary winding L1, which path starts from the positive terminal of the DC power source unit 11, passes through the primary winding L1 of the ignition coil 13, and reaches the negative terminal of the DC power source unit 11. Thus, primary current i1 flows through the primary winding L1. At this time, the current flowing from the primary winding L1 into the capacitor 87 flows through the diode 89.

As charge is accumulated in the capacitor 87 by virtue of the primary current i1 flowing through the electricity supply path, the primary current i1 decreases gradually. When a predetermined amount of charge has been accumulated in the capacitor 87 at a certain time constant determined by the inductance of the primary winding L1 and the capacitance of the capacitor 87, the flow of current through the capacitor 87 stops, and thus, the primary current i1 is interrupted.

However, in the case in which the capacitor 87 has been charged such that the electrode connected to the primary winding L1 assumes a positive polarity and a potential difference greater than the voltage of the DC power source unit 11 is produced across the capacitor 87, even when the first spark-discharge interruption command signal Sb1 is at a high level, no primary current i1 flows. Therefore, the charge accumulated in the capacitor 87 must be discharged in advance. In view of this, in the present embodiment, when the first spark-discharge interruption command signal Sb1 is at a low level, the first ignition command signal Sa1 for generation of high voltage for ignition is brought into a high level; i.e., the main control transistor 15 is brought into an ON state. Through this operation, the charge accumulated in the capacitor 87 can be discharged.

That is, when the main control transistor 15 is brought into an ON state, a closed loop is formed by the main control transistor 15, the resistor 91, the capacitor 87, and the diode 83. Since current flows through the closed loop due to charge accumulated in the capacitor 87, the capacitor 87 is discharged. At this time, the current discharged from the capacitor 87 flows not through the diode 89 but through the resister 91. Therefore, the current flowing through the closed loop decreases in amplitude, and thus the amount of current flowing through the main control transistor 15 is suppressed. This reduces the generation of heat by the main control transistor 15 at the time of discharging the charge accumulated in the capacitor 87.

Accordingly, when the level of the first spark-discharge interruption command signal Sb1 is changed from low to high in the state in which the capacitor 87 has been discharged and the spark plug 17 is generating spark discharge, the electricity-supply resumption circuit 51 resumes supply of primary current i1 to the primary winding L1 to thereby interrupt the spark discharge of the spark plug 17. Subsequently, the electricity-supply resumption circuit 51 causes the primary current i1 to decrease gradually with time, and eventually interrupts the primary current i1. Subsequently, when the level of the first ignition command signal Sa1 is again changed to high in order to generate high voltage for the next ignition in the same cylinder, the charge accumulated in the capacitor 87 is discharged in preparation for subsequent spark discharge interruption.

The above-described main control transistor 15 and the transistor 85 must have a large current amplification factor in order to supply a relatively large primary current i1 in response to a small current output from the signal processing control circuit 23, which is constituted by a microcomputer. Therefore, in actuality, each of the main control transistor 15 and the transistor 85 is configured by a circuit as shown by a circuit diagram of FIG. 2. That is, each of the main control transistor 15 and the transistor 85 consists of three transistors; i.e., a first npn transistor Tr1, a second pnp transistor Tr2, and a third npn transistor Tr3. In the following, the circuit configuration will be de described while the main control transistor 15 is taken as an example.

Figure 2:
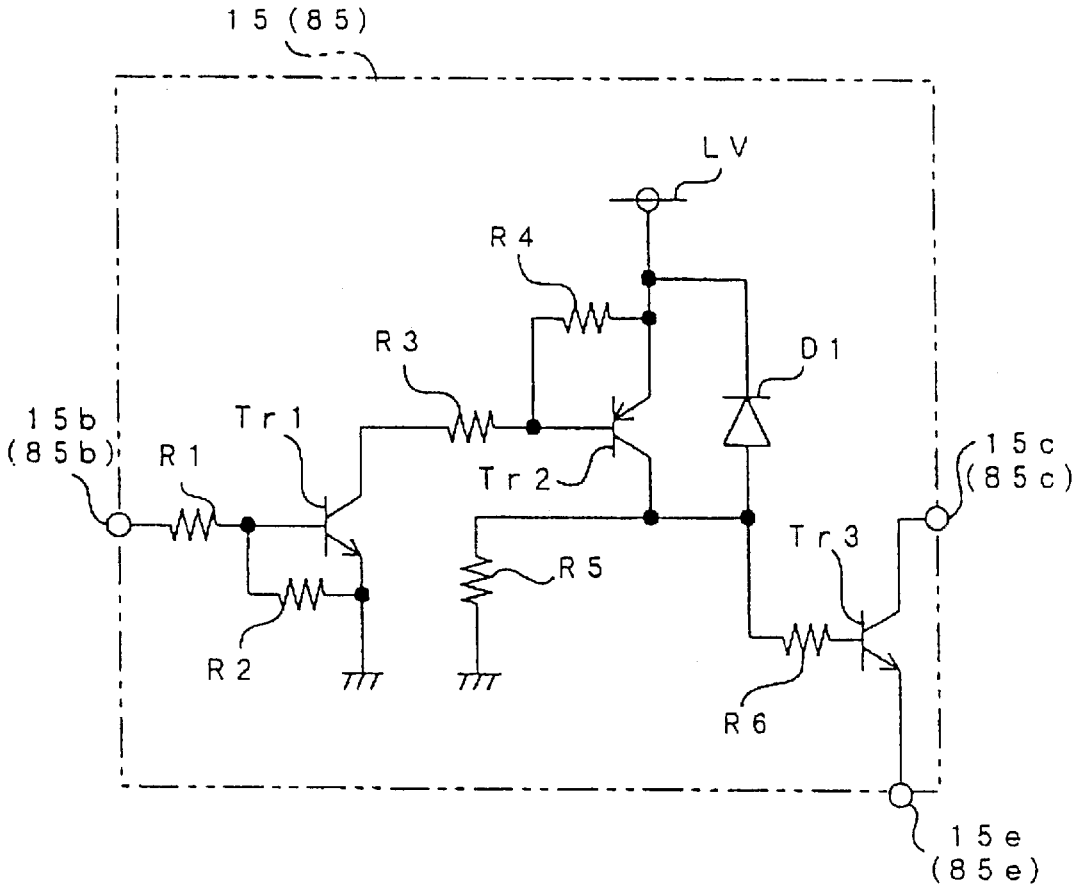
FIG. 2 is a circuit diagram showing the detailed configuration of the main control transistor 15 and the transistor 85.

As shown in FIG. 2, a resister R1 is connected to the base of the first transistor Tr1. The base and emitter of the first transistor Tr1 are mutually connected by a resistor R2. The emitter of the first transistor Tr1 is grounded. The collector of the first transistor Tr1 is connected to the base of the second transistor Tr2 via a resistor R3. An end of the resistor RI opposite the end connected to the base of the first transistor Tr1 corresponds to the base terminal of the main control transistor 15.

The base and emitter of the second transistor Tr2 are mutually connected by a resistor R4. The emitter of the second transistor Tr2 is connected to a power source line LV, to which constant voltage is supplied. The collector and emitter of the second transistor Tr2 are mutually connected by a diode D1. The collector of the second transistor Tr2 is grounded via a resistor R5. Notably, the anode of the diode D1 is connected to the collector of the second transistor Tr2; and the cathode of the diode D1 is connected to the emitter of the second transistor Tr2.

The base of the third transistor Tr3 is connected to the collector of the second transistor Tr2 via a resistor R6. The emitter of the third transistor Tr3 corresponds to the emitter terminal 15*e* of the main control transistor 15. The collector of the third transistor Tr3 corresponds to the collector terminal 15*c* of the main control transistor 15.

When the level of a signal input to the base terminal 15*b* is high, a potential difference is produced between the base and emitter of the first transistor Tr1, and thus base current flows, whereby the first transistor Tr1 enters an ON state. When the first transistor Tr1 enters an ON state, current flows from the power source line LV to ground via the resistors R4 and R3. As a result, a potential difference is produced between the base and emitter of the second transistor Tr2, and thus base current flows, whereby the second transistor Tr2 enters an ON state. When the second transistor Tr2 enters an ON state, current flows from the power source line LV to the base of the third transistor Tr3 via the second transistor Tr2 and the resistor R6. Therefore, the third transistor Tr3 enters an ON state.

When the level of the signal input to the base terminal 15*b* is low, the first transistor Tr1 enters an OFF state, and the second transistor Tr2 also enters an OFF state. Therefore, no current flows from the power source line LV to the third transistor, and consequently, the third transistor Tr3 also enters an OFF state.

Therefore, the circuit shown in FIG. 2 operates as follows. When the signal input to the base terminal 15*b* is at a high level, electrical continuity is established between the collector terminal 15*c* and the emitter terminal 15*e* (i.e., the terminals 15*c* and 15*e* are short-circuited). When the signal input to the base terminal 15*b* is at a low level, electrical continuity is not established between the collector terminal 15*c* and the emitter terminal 15*e* (i.e., the terminals 15*c* and 15*e* are isolated from each other).

That is, the circuit shown in FIG. 2 operates in the same manner as a single npn transistor. Further, since three transistors are combined, the circuit has a high current amplification factor. Therefore, the main control transistor 15, which has a circuit configuration shown in FIG. 2, can be driven by small current output from the signal processing control circuit in order to supply primary current i1.

Further, the transistor 85 also has a circuit configuration shown in FIG. 2. The base 85*b* corresponds to the base 15*b* of the main control transistor 15; the emitter 85*e* corresponds to the emitter 15*e* of the main control transistor 15; and the collector 85*c* corresponds to the collector 15*c* of the main control transistor 15.

Figure 4:
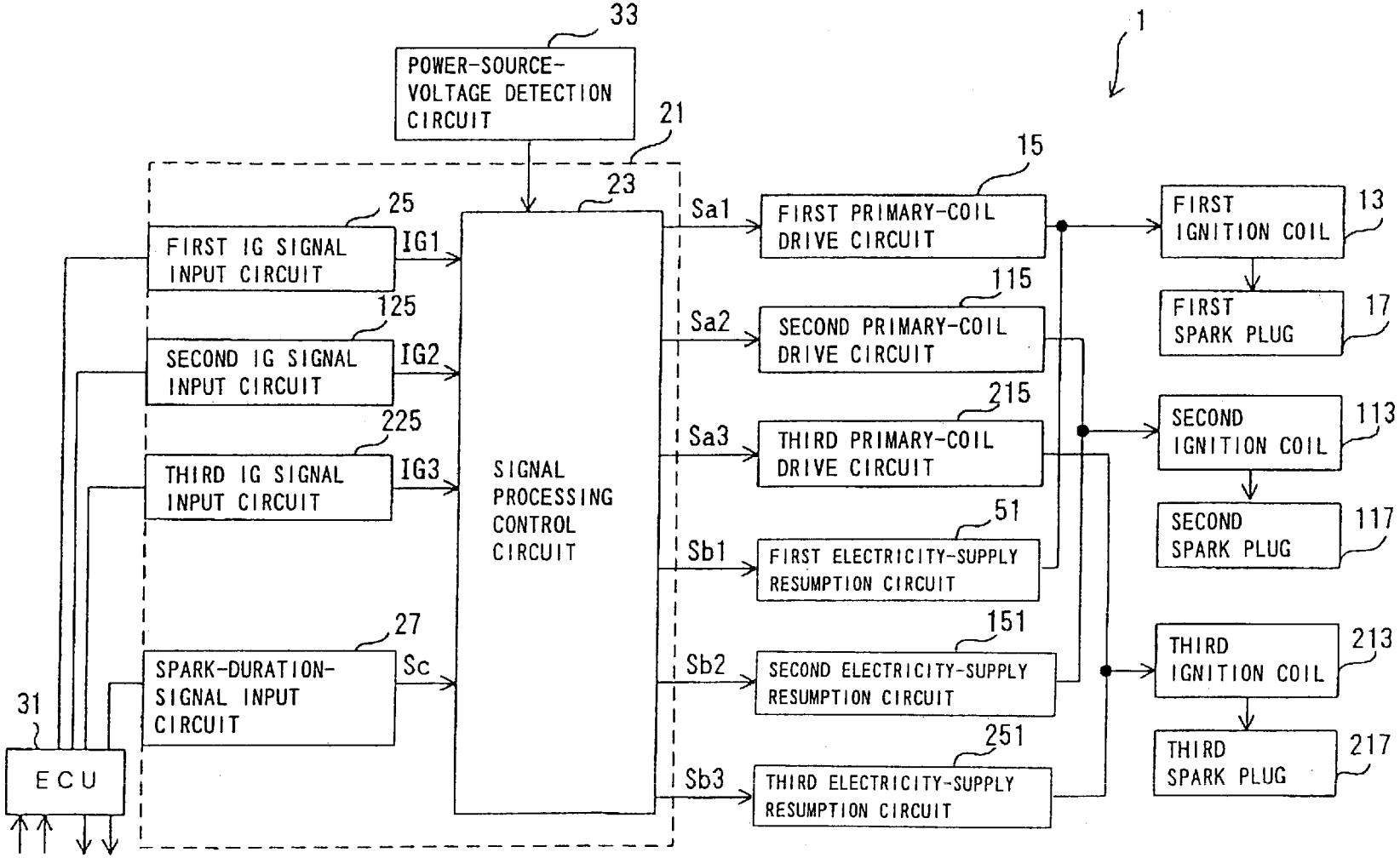
FIG. 4 is a schematic diagram showing the configuration of the engine igniter according to the first embodiment.

FIG. 4 shows a schematic configuration of the engine igniter 1 according to the present embodiment which includes primary-coil drive circuits, electricity-supply resumption circuits, ignition coils, and spark plugs for three cylinders. Notably, the first primary-coil drive circuit 15 corresponds to the main control transistor 15 shown in FIG. 1; the first ignition coil 13 corresponds to the ignition coil 13 shown in FIG. 1; the first spark plug 17 corresponds to the spark plug 17 shown in FIG. 1; and the first electricity-supply resumption circuit 51 corresponds to the electricity-supply resumption circuit 51 shown in FIG. 1.

As shown in FIG. 4, the first through third ignition command signals Sa1 to Sa3 output from the signal processing control circuit 23 are fed to the first primary-coil drive circuit 15, the second primary-coil drive circuit 115, and the third primary-coil drive circuit 215, respectively. Further, the first through third spark-discharge interruption command signals Sb1 to Sb3 output from the signal processing control circuit 23 are fed to the first electricity-supply resumption circuit 51, the second electricity-supply resumption circuit 151, and the third electricity-supply resumption circuit 251, respectively.

The first primary-coil drive circuit 15 and the first electricity-supply resumption circuit 51 provided for the first cylinder are connected to the first ignition coil 13 and control intermittent supply of electricity to the primary winding L1 of the first ignition coil 13 to thereby cause the first spark plug 17 to generate spark discharge and to interrupt the spark discharge.

The second primary-coil drive circuit 115 and the second electricity-supply resumption circuit 151 provided for the second cylinder are connected to the second ignition coil 113. The third primary-coil drive circuit 215 and the third electricity-supply resumption circuit 251 provided for the third cylinder are connected to the third ignition coil 213. Further, the second spark plug 117 is connected to the second ignition coil 113; and the third spark plug 217 is connected to the third ignition coil 213.

Notably, the second and third primary-coil drive circuits 115 and 215 are configured in the same manner as the main control transistor 15 shown in FIG. 1; the second and third ignition coils 113 and 213 are configured in the same manner as the ignition coil 13 shown in FIG. 1; the second and third spark plugs 117 and 217 are configured in the same manner as the spark plug 17 shown in FIG. 1; and the second and third electricity-supply resumption circuits 151 and 251 are configured in the same manner as the electricity-supply resumption circuit 51 shown in FIG. 1.

By virtue of the above-described configuration, in the second and third cylinders as well, generation and interruption of spark discharge at the second and third spark plugs 117 and 217 are effected in the same manner as in the case of the first cylinder. Thus, the engine igniter 1 according to the present embodiment configured in the above-described manner generates and interrupts spark discharge in each of the three cylinders to thereby operate the internal combustion engine.

Figure 3:
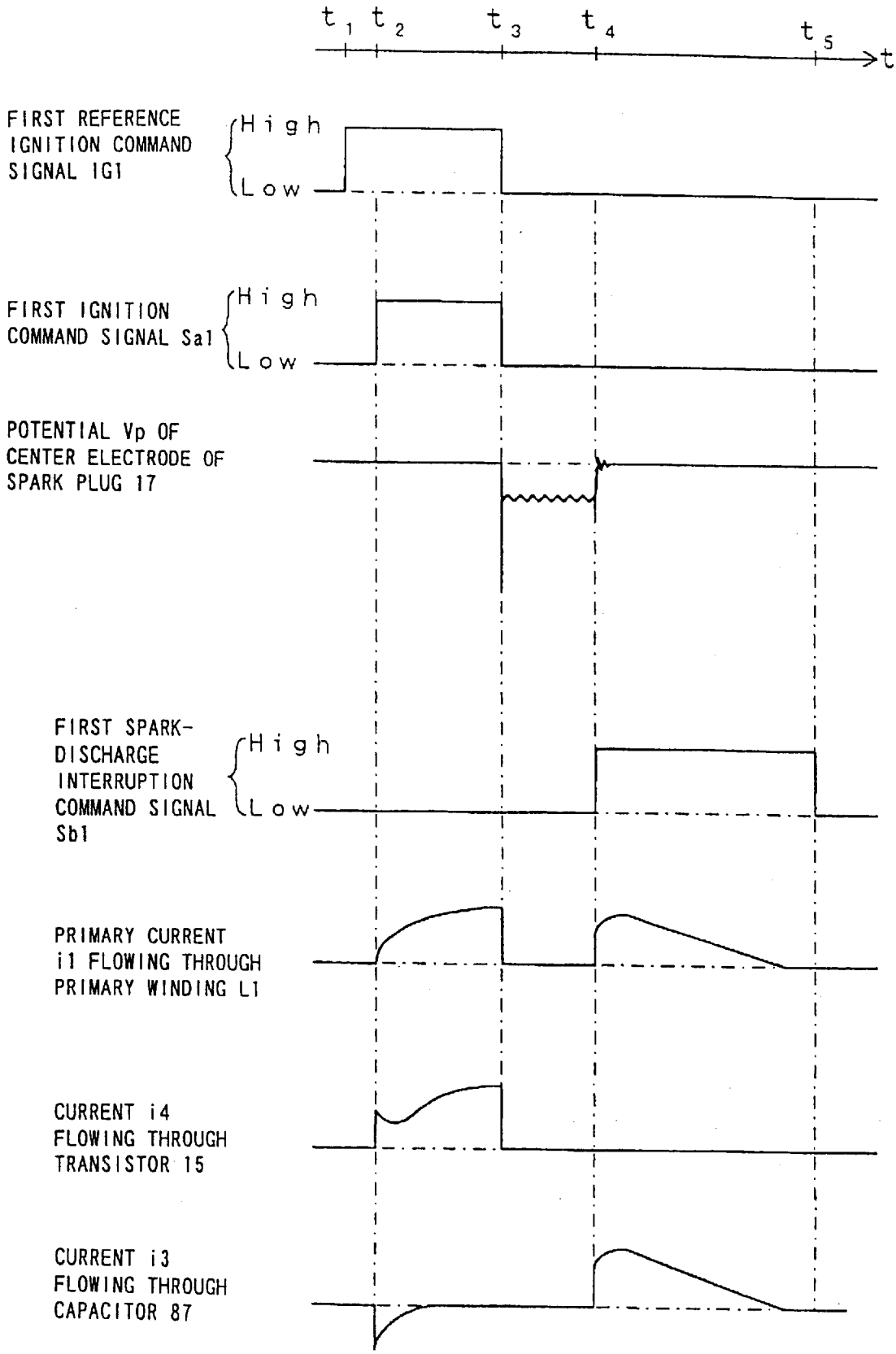
FIG. 3 is a time chart showing the states of respective portions of the engine igniter according to the first embodiment.

FIG. 3 shows a time chart representing variations with time in the first reference ignition command signal IG1, the first ignition command signal Sa1, potential Vp of the center electrode 17*a* of the spark plug 17, the first spark-discharge interruption command signal Sb1, primary current i1 flowing through the primary winding L1, current i4 flowing through the main control transistor 15, and current i3 flowing through the capacitor 87, all of which appear in the circuit diagram for the first cylinder illustrated in FIG. 1.

The level of the first reference ignition command signal IG1 is switched from low to high at time t1 shown in FIG. 3. Subsequently, on the basis of the power source voltage detected by the power-source-voltage detection circuit 33, the level of the first ignition command signal Sa1 is switched from low to high at time t2; i.e., when an electricity-supply-start delay time Ts set by the signal processing control circuit 23 has elapsed. As a result, the main control transistor 15 enters an ON state, and thus, primary current i1 starts to flow through the primary winding L1 of the ignition coil 13. Subsequently, at time t3; i.e., when an electricity supply period set with time t1 regarded as a start point has elapsed, the level of the first ignition command signal Sa1 is switched from high to low in response to a change in the level of the first reference ignition command signal IG1. Consequently, supply of the primary current i1 to the primary winding L1 of the ignition coil 13 is interrupted, and thus, negative high voltage for ignition is applied to the center electrode 17*a* of the spark plug 17. As a result, the potential Vp of the center electrode 17*a* decreases abruptly, and thus, spark discharge is generated between the electrodes 17*a* and 17*b* of the spark plug 17.

At time t2, at which the main control transistor 15 enters the ON state, a closed loop is formed by the capacitor 87, the resistor 91, the main control transistor 15, and the diode 83 to thereby discharge the charge that has been accumulated in the capacitor 87 due to primary current re-supplied at the time of interruption of spark discharge during a previous combustion cycle of the cylinder. Therefore, current i4 flows from the capacitor 87 while passing through the resistor 91, the main control transistor 15, and the diode 83, in this sequence. Notably, in FIG. 3, the direction of current i3 flowing from the resistor 91 toward the capacitor 87 is assumed to be a positive direction. Therefore, the current i3 flowing during the above-described discharge period is negative current.

At this time, both the primary current i1 flowing through the primary winding L1 and the current i3 flow into the collector of the main control transistor 15. Therefore, the current i4 flowing through the main control transistor 15 assumes a waveform resulting from superposition of the current i3 on the primary current i1.

In order to suppress heat generation in the main control transistor 15, the magnitude of the current i4 is desirably decreased by reducing the magnitude of the current i3. Therefore, the resistance of the resistor 91 is preferably set so as to decrease the current i3. However, the resistance of the resistor 91 is desirably set such that the capacitor 87 can be discharged completely within a period in which the first ignition command signal Sa1 is at a high level (a period from t2 to t3).

Subsequently, the level of the first spark-discharge interruption command signal Sb1 is changed from low to high at time t4 shown in FIG. 3 at which the spark discharge of the spark plug 17 continues. In response thereto, transistor 85 turns on, and thus, a current path is formed which starts from the positive terminal of the DC power source unit 11, passes through the primary winding L1 of the ignition coil 13 and the electricity-supply resumption circuit 51, and ends at the negative terminal of the DC power source unit 11, resulting in resumption of supply of the primary current i1 to the primary winding L1. As a result, the spark discharge of the spark plug 17 is interrupted. At this time, the current path within the electricity-supply resumption circuit 51 is formed by the diode 89, the capacitor 87, and the transistor 85; as charge is accumulated in the capacitor 87, the primary current i1 decreases gradually; and when the charging is completed after accumulation of a predetermined amount of charge in the capacitor 87, the flow of the primary current i1 stops.

Since the charge accumulated in the capacitor 87 is discharged before time t3, at time t4, the capacitor 87 permits the primary current i1 to flow therethrough at a level necessary to interrupt the spark discharge.

As described above, supply of the primary current i1 is resumed in response to a change in the level of the first spark-discharge interruption command signal Sb1 during a period in which high voltage for ignition is generated by interrupting the primary current i1, which interruption is effected in response to a change in the level of the first ignition command signal Sa1 (i.e., during the period in which the spark plug 17 is generating spark discharge). Due to resumption of supply of the primary current i1, the direction of change in magnetic flux within the ignition coil 13 is reversed, and consequently, a voltage of reverse polarity is generated at the secondary winding L2. Upon generating a voltage having a polarity which is opposite that during the spark discharge, the above-described rectifying element D prevents current from flowing to the spark plug 17. Thus, the spark plug 17 becomes unable to generate spark discharge.

As understood from the above description, as shown in FIG. 3, when the electricity-supply resumption circuit 51 resumes supply of electricity to the primary winding L1 in accordance with the first spark-discharge interruption command signal Sb1 during a period in which spark discharge is produced between the electrodes 17*a* and 17*b* by virtue of a sufficiently low potential Vp of the center electrode 17*a* of the spark plug 17, the potential Vp of the center electrode 17*a* of the spark plug 17 can be elevated in order to interrupt the spark discharge.

In the engine igniter 1 of the present embodiment, supply of electricity to the primary winding L1 is started when an electricity-supply-start delay time set in accordance with the power source voltage output from the DC power source unit 11 has elapsed (time t2 in FIG. 3) after the time (time t1 in FIG. 3) at which supply of electricity to the primary winding L1 is started and which is set in accordance with the operation conditions of the internal combustion engine. The electricity-supply-start delay time is set in the signal processing control circuit 23. The details of the process which is performed in the signal processing control circuit 23 in order to set the electricity-supply-start delay time will be described below.

Next, ignition control processing performed in the ECU 31 will be described.

As described above, the ECU 31 totally controls the spark-discharge generation timing, fuel injection amount, idle engine speed, etc., of the internal combustion engine. In addition to ignition control processing, which will be described below, the ECU 31 performs operation condition detection processing for detecting operation conditions of various sections of the engine, such as intake air amount (intake pipe pressure), engine speed, throttle opening, coolant temperature, and intake air temperature; and fuel control processing for supplying fuel to the intake pipe at a fuel injection timing.

After startup of the internal combustion engine, the ignition control processing is performed once during each combustion cycle, including intake, compression, combustion, and exhaust, of the internal combustion engine, on the basis of, for example, a signal from a crank-angle sensor for detecting the rotational angle of the engine (crank angle). The ignition control processing is performed for each cylinder, and in the following description, the ignition control processing for the first cylinder will be described.

When the ignition control processing is started upon startup of the internal combustion engine, operation conditions of the internal combustion engine detected by the operation condition detection processing performed separately are read. Subsequently, an ignition timing suitable for the operation conditions of the internal combustion engine is set on the basis of the operation conditions that have been read and by use of a previously prepared map or calculation formula. Thus, the ignition timing in the present combustion cycle is set. Notably, the above-described map or calculation formula for setting an ignition timing is preferably configured such that an ignition timing suitable for the operation conditions of the internal combustion engine is determined while the operation conditions of the internal combustion engine such as engine speed and engine load are used as parameters.

Subsequently, while using the set ignition timing as a reference point, the ignition control processing changes the level of the first reference ignition command signal IG1 to high at a time which is earlier than the ignition timing by a predetermined period of time. The predetermined period of time serves as a primary-current supply period before generation of spark discharge. In order to generate spark discharge which enables reliable ignition of fuel even under operation conditions under which fuel has poor ignitability; i.e., in order to generate sufficiently high voltage for ignition, the primary-current supply period is preset such that sufficiently large magnetic flux energy is accumulated in the ignition coil during that period. Thus, the spark discharge duration time; i.e., a period of time from generation of spark discharge to natural termination of the spark discharge, becomes sufficiently long. As a result, even under operation conditions under which fuel has poor ignitability, such as low-speed, light-load conditions, the spark discharge can assist growth of a flame kernel to thereby reliably burn a fuel-air mixture.

Notably, supply of electricity to the primary winding L1 is actually started when the electricity-supply-start delay time has elapsed (time t2 shown in FIG. 3) after the level of the first reference ignition command signal IG1 has been changed to high. That is, when the signal processing control circuit 23 changes the level of the first ignition command signal Sa1 to high, the main control transistor 15 enters an ON state to start supply of electricity to the primary winding L1.

The ignition control processing changes the level of the first reference ignition command signal IG1 to low when the primary-current supply period has elapsed after the level of the first reference ignition command signal IG1 has been changed to high. Simultaneously with this, the signal processing control circuit 23 changes the level of the first ignition command signal Sa1 to low in order to bring the main control transistor 15 into an OFF state. When the main control transistor 15 enters the OFF state, the primary current i1 is interrupted abruptly, and thus, high voltage for ignition, which is induced electromotive force, is generated at the secondary winding L2, whereby the spark plug 17 generates spark discharge.

As described above, the ignition control processing sets an ignition timing in accordance with operation conditions of the internal combustion engine, and changes the level of the first reference ignition command signal IG1 to high at a time which is earlier than the ignition timing by a predetermined primary-current supply period. Subsequently, when the primary-current supply period has elapsed; i.e., at the ignition timing set in accordance with the operation conditions of the internal combustion engine, the ignition control processing changes the level of the first reference ignition command signal IG1 to low in order to cause the spark plug 17 to generate spark discharge between the electrodes thereof, to thereby burn fuel.

Next, the processing which is performed in the ECU 31 in order to set a spark-discharge duration time will be described. The spark-discharge duration time setting processing is started simultaneously with the startup of the internal combustion engine. In the engine igniter of the present embodiment, the spark-discharge duration time setting processing is not performed on a cylinder-by-cylinder basis, but a spark-discharge duration time common among all the cylinders is set.

When started, the spark-discharge duration time setting processing first judges whether the internal combustion engine has been warmed up sufficiently. When the warm-up is judged to be insufficient, the spark-discharge duration time is set to 0 sec.

The judgment as to whether the warm-up is sufficient is performed, for example, by judging whether the temperature of coolant or lubricant of the internal combustion engine is in excess of a preset value used for judging warm-up completion.

When the temperature of the internal combustion engine has increased as a result of continued operation of the internal combustion engine and the engine has been judged to have warmed up sufficiently, the operation conditions (engine speed, engine load, etc.) of the internal combustion engine separately detected by the operation condition detection processing are read. Subsequently, a spark-discharge duration time Tc suitable for the operation conditions of the internal combustion engine is set on the basis of the operation conditions that have been read and by use of a previously prepared map or calculation formula. Notably, the above-described map or calculation formula for setting a spark-discharge duration time Tc is preferably defined on the basis of, for example, several measurement data sets, such that a spark-discharge duration time Tc suitable for the operation conditions of the internal combustion engine is determined, while at least the engine speed and the engine load are used as parameters.

Subsequently, the spark-discharge duration time setting processing performs at constant intervals the above-described series of reading the operation conditions of the internal combustion engine and setting the spark-discharge duration time Tc by use of a map or calculation formula. Further, every time the spark-discharge duration time Tc is changed, the spark-discharge duration time setting processing outputs a spark duration signal Sc to the signal processing unit 21 in order to communicate the spark-discharge duration time Tc thereto. For example, floating-point numerical data representing the spark-discharge duration time Tc is preferably used as the spark duration signal Sc.

As described above, the spark-discharge duration time setting processing performs processing for setting a spark-discharge duration time Tc suitable for the operation conditions of the internal combustion engine, and for communicating the spark-discharge duration time Tc to the signal processing unit 21 by use of the spark duration signal Sc.

Next, ignition signal control processing performed by the signal processing control circuit 23 of the signal processing unit 21 will be described. Notably, in the following description, only the ignition signal control processing for the first cylinder will be described; however, similar ignition signal control processing is performed for the second and third cylinders.

When started upon startup of the internal combustion engine, the ignition signal control processing sets the level of the first ignition command signal Sa1 in accordance with the level of the first reference ignition command signal IG1, which is input from the ECU 31 via the first IG signal input circuit 25.

That is, the ignition signal control processing changes the level of the first ignition command signal Sa1 in order to start and stop supply of electricity to the primary winding L1 at a timing for starting supply of electricity to the primary winding L1 and an ignition timing, respectively. Both timings are set by the ignition control processing of the ECU 31 in accordance with the operation conditions of the internal combustion engine.

As described above, the level of the first ignition command signal Sa1 is basically determined by the ignition signal control processing. However, when the first ignition command signal Sa1 is set to a low level by means of electricity-supply-start timing delay control processing, which will be described below, priority is given to control by the electricity-supply-start timing delay control processing, and thus, the first ignition command signal Sa1 is maintained at the low level. Notably, this also holds true for the second and third ignition command signals Sa2 and Sa3.

Next, the electricity-supply-start timing delay control processing performed by the signal processing control circuit 23 will be described with reference to the flowchart shown in FIG. 5. Upon startup of the internal combustion engine, the electricity-supply-start timing delay control processing is started for each cylinder. Notably, in the following description, the electricity-supply-start timing delay control processing for the first cylinder will be described.

When the electricity-supply-start timing delay control processing is started, in step S110, a counter value N is set to zero to thereby reset the counter value N. The counter value N is used for determining a timing for detecting power source voltage.

Subsequently, in step S120, the electricity-supply-start delay time Ts is set to an initial value, desirably to a value suitable for the operation conditions of the internal combustion engine immediately after the startup thereof. Since the temperature of the internal combustion engine is low immediately after startup, ignitability of fuel is poor. Therefore, the electricity-supply-start delay time Ts is preferably set to zero or a value such that the primary-current supply period becomes long.

In subsequent step S130, a judgment is made as to whether the first reference ignition command signal IG1 output from the ECU 31 has risen (from low level to high level). When the judgment result is YES, processing proceeds to step S140. When the judgment result is NO, the processing in step S130 is performed repeatedly in order to wait until the level of the first reference ignition command signal IG1 changes. That is, in step S130, a judgment is made as to whether the timing for supplying electricity to the primary winding L1 has come, which is determined by the ignition control processing performed in the ECU 31.

When the result of the judgment in step S130 is YES, processing proceeds to step S140. In step S140, the first ignition command signal Sa1 is set to a low level (time t1 in FIG. 3). As a result, the first ignition command signal Sa1 input to the base of the main control transistor 15 is maintained at a low level. That is, the main control transistor 15 maintains the OFF state irrespective of the command from the ECU 31.

Next, in step S150, a timer is started for measuring a period of time which has elapsed since the level of the first reference ignition command signal IG1 has changed (after the result of the judgment in step S130 has become YES).

In subsequent step S160, a judgment is made as to whether the value of the timer started in step S150 is equal to or greater than the electricity-supply-start delay time Ts. When the judgment result is YES, processing proceeds to step S170. When the judgment result is NO, the processing in step S160 is performed repeatedly in order to wait until the timer value becomes equal to or greater than the electricity-supply-start delay time Ts. That is, in step S160, a judgment is made as to whether the electricity-supply-start delay time Ts has elapsed after the level of the first reference ignition command signal IG1 has changed (after the result of the judgment in step S130 has become YES).

When the result of the judgment in step S160 is YES, processing proceeds to step S170. In step 170, the processing for maintaining the first ignition command signal Sa1 at the low level is ended (at time t2 in FIG. 3). Therefore, the level of the first ignition command signal Sa1 is determined by the ignition signal control processing. When the level of the first reference ignition command signal IG1 output from the ECU 31 is high, the level of the first ignition command signal Sa1 becomes high. As a result, the main control transistor 15 enters an ON state, and thus, primary current i1 starts to flow through the primary winding L1.

Subsequently, the level of the first reference ignition command signal IG1 is changed from high to low by means of the above-described ignition control processing, which is separately performed by the ECU 31. As a result, the level of the first ignition command signal Sa1 changes to low in order to interrupt the primary current i1, whereby spark discharge is produced between the electrodes of the spark plug 17 (time t3 in FIG. 3).

After completing the processing in step S170, processing proceeds to step S180. In step S180, the timer having started in step S150 is stopped. In subsequent step S190, the timer value is set to zero to thereby reset the timer.

In subsequent step S200, one is added to the counter value N (the counter value N is incremented) in order to update the counter value N.

In subsequent step S210, a judgment is made as to whether the counter value N is equal to or greater than 5. When the judgment result is YES, processing proceeds to step S220. When the judgment result is NO, processing returns to step S130. Notably, the present electricity-supply-start timing delay control processing detects power source voltage every five combustion cycles of the cylinder; and in step S210, a judgment is made as to whether a combustion cycle (timing) for detection of power source voltage has come.

When the result of the judgment in step S210 is NO, processing returns to step S130. In step S130, an electricity-supply-start timing in the next combustion cycle set by the ECU 31 is detected. Subsequently, the processing in steps S130 to S210 is repeatedly performed until the counter value N becomes equal to or greater than 5; i.e., until the result of the judgment in step S210 becomes YES. Thus, the electricity-supply-start timing in each combustion cycle is delayed by using the same electricity-supply-start delay time Ts.

When the counter value N becomes equal to or greater than 5 after iterative performance of the electricity-supply-start timing delay processing using the same electricity-supply-start delay time Ts, the result of the judgment in step S210 becomes YES, and processing proceeds to step S220. In step S220, the magnitude of the power source voltage is calculated on the basis of the divided voltage Vs input from the power-source-voltage detection circuit 33. That is, the magnitude of the power source voltage is calculated by multiplying the detected divided voltage Vs by the ratio of the power source voltage to the divided voltage Vs, which is determined by the respective resistances of the two resistors provided in the power-source-voltage detection circuit 33.

In subsequent step S230, on the basis of the magnitude of the power source voltage calculated in step S220, the electricity-supply-start delay time Ts is set by use of a map or calculation formula which uses the magnitude of the power source voltage as a parameter. The map or calculation formula which is used in step S230 to determine the electricity-supply-start delay time Ts is prepared on the basis of, for example, results of a measurement performed in advance, such that substantially constant magnetic flux energy is accumulated in the ignition coil 13; i.e., an optimal electricity-supply-start delay time Ts is obtained in accordance with the magnitude of the power source voltage. Specifically, the map or calculation formula is configured such that the electricity-supply-start delay time Ts increases with the magnitude of the power source voltage.

In subsequent step S240, the counter value N used for detecting the timing for detection of the power source voltage is set to zero to thereby reset the counter value N. After completing the processing in step S240, processing proceeds to step S130.

After this point in time, the electricity-supply-start timing delay control processing controls the delay in the timing for starting supply of primary current i1, while using the electricity-supply-start delay time Ts set in step S230. Subsequently, the processing in steps S130 to S210 is performed repeatedly. When the electricity-supply-start timing delay processing has been performed using the same electricity-supply-start delay time Ts in five combustion cycles of the cylinder, the result of the judgment in step S210 become YES, and processing proceeds to step S220. Thus, the processing in steps S220 to S240 is repeated in order to update the electricity-supply-start delay time Ts.

As described above, the electricity-supply-start timing delay processing controls the timing for starting supply of primary current i1 on the basis of a predetermined initial value of the electricity-supply-start delay time Ts immediately after startup of the internal combustion engine; subsequently detects power source voltage every five combustion cycles of the cylinder; and updates the electricity-supply-start delay time Ts on the basis of the detected power source voltage. The electricity-supply-start timing delay processing delays the timing for starting supply of electricity to the primary winding L1 on the basis of the latest value of the electricity-supply-start delay time Ts.

Next, the spark-discharge interruption control processing performed by the signal processing control circuit 23 will be described with reference to the flowchart shown in FIG. 6.

The spark-discharge interruption control processing is performed once every combustion cycle for each cylinder. The spark-discharge interruption control processing is started when the reference ignition command signal IG for the corresponding cylinder has risen (from low level to high level) after startup of the internal combustion engine. In the following description, the spark-discharge interruption control processing for the first cylinder will be described.

When the spark-discharge interruption control processing is started, in step S550, the spark-discharge duration time Tc communicated from the ECU 31 by means of the spark duration signal Sc is first read so as to be used in subsequent processing. Since the spark duration signal Sc is always output from the ECU 31 to the signal processing control circuit 23, the spark-discharge interruption control processing fetches the spark-discharge duration time Tc by performing the processing in step S550 and interrupts spark discharge.

In subsequent step S560, a judgment is made as to whether an ignition timing has come, on the basis of a change in the level of the first reference ignition command signal IG1 (from high to low). When the judgment result is YES, processing proceeds to step S570. When the judgment result is NO, the processing in step S560 is performed repeatedly for the purpose of awaiting the ignition timing. When the ignition timing for the first cylinder has come, and the result of the judgment in step S560 becomes YES, processing proceeds to step S570. In step S570, the present time t is set to a time variable T2 in order to memorize the time of the ignition timing.

In subsequent step S580, a judgment is made as to whether a value obtained through subtraction of the time variable T2 from the present time t; i.e., the value of t−T2, is equal to the spark-discharge duration time Tc determined in step S550. When the judgment result is YES, processing proceeds to step S590. When the judgment result is NO, the processing at S580 is performed repeatedly for the purpose of awaiting elapse of the spark-discharge duration time. That is, the processing in step S580 detects a spark-discharge interruption timing; i.e., passage of the spark-discharge duration time Tc after the ignition timing detected in step S560.

When the spark-discharge interruption timing has come and thus the result of the judgment in step S580 becomes YES, processing proceeds to step S590. In step S590, the spark-discharge interruption operation is performed. Specifically, the level of the first spark-discharge interruption command signal Sb1 is changed to high (time t4 in FIG. 3) in order to operate the electricity-supply resumption circuit 51 to thereby cause current (primary current i1) to flow through the primary winding L1 again. Thus, the spark discharge is interrupted. When the electricity-supply resumption circuit 51 is operated by changing the level of the first spark-discharge interruption command signal Sb1 to high, the flow of the primary current i1 stops or decreases to a small level within a predetermined period of time (time t5 in FIG. 3), which has been set previously. Upon passage of this predetermined period of time, the level of the first spark-discharge interruption command signal Sb1 is changed to low. Subsequently, the processing in step S590 is ended, and the spark-discharge interruption control processing is ended.

As described above, the spark-discharge interruption control processing reads the spark-discharge duration time Tc communicated from the ECU 31; and outputs the first spark-discharge interruption command signal Sb1 at a spark-discharge interruption timing; i.e. when the spark-discharge duration time Tc has elapsed from the ignition timing, in order to operate the electricity-supply resumption circuit 51 to thereby interrupt spark discharge.

In the engine igniter of the present embodiment, the main control transistor 15 corresponds to the switching means; the ignition control processing performed by the ECU 31 and the ignition signal control processing performed by the signal processing control circuit 23 correspond to the ignition control means; the transistor 85 corresponds to the spark-discharge interruption switching means; the capacitor 87 corresponds to the current adjustment means; the spark-discharge duration time setting processing performed by the ECU 31 corresponds to the spark-discharge duration time setting means; the spark-discharge interruption control processing performed by the signal processing control circuit 23 corresponds to the spark-discharge interruption control means; and the electricity-supply-start timing delay control processing performed by the signal processing control circuit 23 corresponds to the electricity-supply-start timing delay means. Further, the ECU 31 corresponds to the main controller; the signal processing unit 21 corresponds to the signal processing unit; and the signal processing control circuit 23 corresponds to the signal processing control means.

As described above, in the engine igniter 1 of the present embodiment, on the basis of the first through third reference ignition command signals IG1 to IG3 output from the ECU 31, the signal processing unit 21 outputs the first through third ignition command signals Sa1 to Sa3 to thereby operate the main control transistor 15. High voltage for ignition, which is generated at the secondary winding L2 of the ignition coil 13 through operation of turning the main control transistor 15 on and off, is applied to the spark plug 17 in order to generate spark discharge between the electrodes 17*a* and 17*b* of the spark plug 17. Subsequently, upon elapse of the spark-discharge duration time Tc which the ECU 31 sets on the basis of operation conditions of the internal combustion engine, the signal processing unit 21 of the engine igniter outputs the first through third spark-discharge interruption command signals Sb1 to Sb3 in order to operate the electricity-supply resumption circuit 51 to thereby resume supply of primary current i1 to the primary winding L1. Thus, spark discharge is interrupted.

In the engine igniter of the present embodiment, when the internal combustion engine is operated under conditions, such as high-speed, heavy-load conditions, in which only a relatively small amount of spark energy is required, the spark-discharge duration time is shortened in order to cause the spark plug to reliably generate spark discharge through application of high voltage, while suppressing excessive supply of spark energy to the spark plug. In contrast, when the internal combustion engine is operated under conditions, such as low-speed, light-load conditions, in which ignition of fuel-air mixture is difficult, the spark-discharge duration time is increased in order to reliably burn the fuel-air mixture. That is, since the spark-discharge duration time is controlled optimally on the basis of operation conditions of the internal combustion engine, generation of multiple discharge and consumption of the electrodes of the spark plug are suppressed to thereby extend the service life of the spark plug. In addition, occurrence of misfire can be suppressed.

In the engine igniter 1 of the present embodiment, even when the ignition control processing performed by the ECU 31 outputs the first reference ignition command signal IG1 of high level in order to start supply of electricity to the primary winding L1, the supply of electricity to the primary winding L1 is not necessarily started at the time that the first reference ignition command signal IG1 is output. That is, during a period in which the electricity-supply-start timing delay control processing performed by the signal processing control circuit 23 maintains the first ignition command signal Sa1 at a low level, the main control transistor 15 is maintained in an OFF state irrespective of the level of the first reference ignition command signal IG1, and thus electricity is not supplied to the primary winding L1.

When the electricity-supply-start delay time Ts set in accordance with the magnitude of power source voltage elapses after the level of the first reference ignition command signal IG1 is changed to high, the operation of the electricity-supply-start timing delay control processing for maintaining the first ignition command signal Sa1 at the low level is ended. At this timing, the level of the first ignition command signal Sa1 is changed to high in accordance with the level of the first reference ignition command signal IG1 in order to start supply of electricity to the primary winding L1.

That is, in the engine igniter of the present embodiment, by performing the electricity-supply-start timing delay control processing, the timing for supplying electricity to the primary winding L1 is delayed in accordance with the magnitude of the power source voltage, whereby the magnetic flux energy accumulated in the ignition coil 13 is maintained at a substantially constant level even when the power source voltage varies. Therefore, the engine igniter of the present embodiment can prevent the magnetic flux energy from excessively accumulating in the ignition coil 13 due to influence of variation in the power source voltage. As a result, it is possible to prevent supply to the capacitor 87 of charge in an amount exceeding an allowable amount, which supply would otherwise be effected at the time of interruption of spark discharge.

Notably, the electricity-supply-start timing delay control processing controls only timing for starting supply of electricity to the primary winding and does not change ignition timing. The engine igniter of the present embodiment causes the spark plug to generate spark discharge at an ignition timing which is determined by the ignition control processing performed by the ECU 31.

Figure 7:
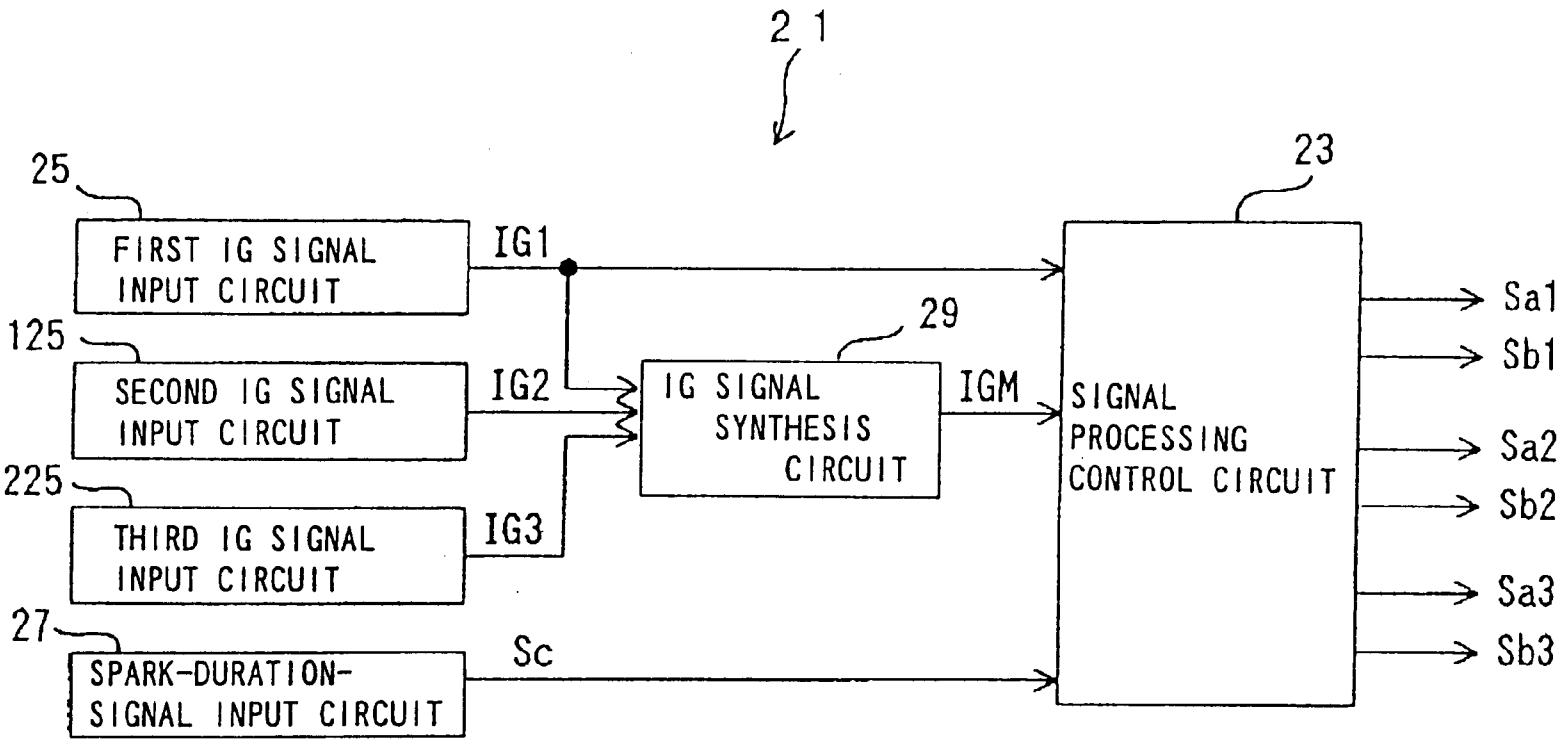
FIG. 7 is a diagram showing the configuration of the signal processing unit 21 of an engine igniter according to a second embodiment of the invention.

Next, an engine igniter will be described according to a second embodiment in which the signal processing control circuit 23 has a reduced number of input terminals as compared with the above-described embodiment (hereinafter referred to as the first embodiment). Since the second embodiment differs from the first embodiment only in the configuration of the signal processing unit 21, the description will focus on portions which differ from those of the first embodiment. FIG. 7 shows the signal processing unit 21 used in the engine igniter of the second embodiment.

As shown in FIG. 7, the signal processing unit 21 of the second embodiment includes an IG signal synthesis circuit 29, in addition to the signal processing control circuit 23, the first IG signal input circuit 25, the second IG signal input circuit 125, the third IG signal input circuit 225, and the spark-duration-signal input circuit 27.

The IG signal synthesis circuit 29 receives the first through third reference ignition command signals IG1 to IG3 from the first IG signal input circuit 25, the second IG signal input circuit 125, and the third IG signal input circuit 225, respectively. Further, the IG signal synthesis circuit 29 outputs a synthesized ignition command signal IGM to the signal processing control circuit 23.

The IG signal synthesis circuit 29 sets the level of the synthesized ignition command signal IGM to high when at least one of the three reference ignition command signals IG is at high level, and sets the level of the synthesized ignition command signal IGM to low when all the three reference ignition command signals IG are at low level.

The signal processing control circuit 23 receives three signal transmitted from the ECU 31; i.e., the fist reference ignition command signal IG1, the spark duration signal Sc, and the synthesized ignition command signal IGM. Therefore, when the ECU 31 changes the level of the first reference ignition command signal IG1 in order to generate spark discharge in the first cylinder, the level of the synthesized ignition command signal IGM changes together with the level of the first reference ignition command signal IG1. By contrast, when the ECU 31 changes the level of the second reference ignition command signal IG2 or the third reference ignition command signal IG3 in order to generate spark discharge in the second or third cylinder, only the level of the synthesized ignition command signal IGM changes.

In the internal combustion engine for which the engine igniter of the present embodiment is provided, spark discharge is always generated in the first cylinder, in the second cylinder, and in the third cylinder, in this sequence. Therefore, when the level of the first reference ignition command signal IG1 and the level of the synthesized ignition command signal IGM change concurrently, the signal processing control circuit 23 detects this change as a reference ignition command signal for the first cylinder, and changes the level of the first ignition command signal Sa1 in accordance with the level of the synthesized ignition command signal IGM. Subsequently, when the level of the synthesized ignition command signal IGM changes, the signal processing control circuit 23 detects this change as a reference ignition command signal for the second cylinder, and changes the level of the second ignition command signal Sa2 in accordance with the level of the synthesized ignition command signal IGM. Subsequently, when the level of the synthesized ignition command signal IGM changes, the signal processing control circuit 23 detects this change as a reference ignition command signal for the third cylinder, and changes the level of the third ignition command signal Sa3 in accordance with the level of the synthesized ignition command signal IGM.

That is, the signal processing control circuit 23 of the second embodiment uses the first reference ignition command signal IG1 for the first cylinder as a reference, and outputs an ignition command signal for the first cylinder, an ignition command signal for the second cylinder, and an ignition command signal for the third cylinder, in this sequence, each time the synthesized ignition command signal IGM is input to the signal processing control circuit 23, to thereby generate spark discharge at proper timing in each of the cylinders.

Since the engine igniter of the second embodiment eliminates the necessity of inputting to the signal processing control circuit 23 reference ignition command signals for all the cylinders, the engine igniter of the second embodiment can operate the internal combustion engine by use of a signal processing control circuit having fewer input terminals as compared with the first embodiment.

Accordingly, the engine igniter of the second embodiment reduces the number of input terminals of the signal processing control circuit provided in the signal processing unit in order to reduce the area occupied by the signal processing control circuit, to thereby increase packaging density.

Notably, in the engine igniter of the second embodiment, the first IG signal input circuit 25 corresponds to the first signal path; and the IG signal synthesis circuit 29 corresponds to the second signal path.

Figure 8:
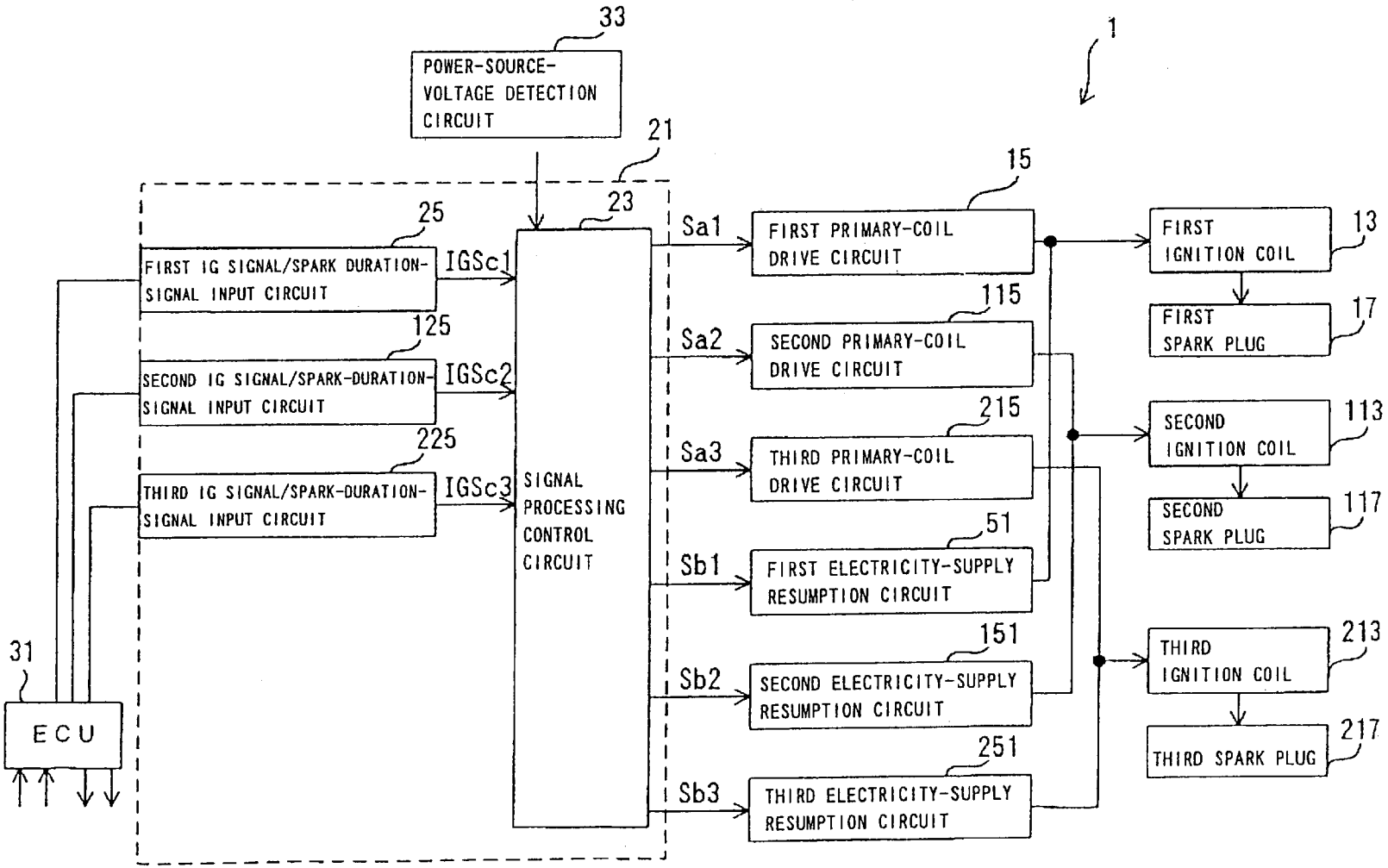
FIG. 8 is a schematic diagram showing the configuration of an engine igniter according to a third embodiment of the invention.

Next, an engine igniter 1 will be described according to a third embodiment which has a reduced number of signal paths extending from the ECU 31 to the signal processing unit 21. FIG. 8 is a diagram schematically showing the configuration of the engine igniter according to the third embodiment.

As shown in FIG. 8, the engine igniter 1 according to the third embodiment includes the above-described signal processing unit 21, a power-source-voltage detection circuit 33, primary-coil drive circuits, ignition coils, spark plugs, and electricity-supply resumption circuits. The engine igniter 1 further includes an unillustrated DC power source unit 11 and the above-described ECU 31. Notably, the primary-coil drive circuit, the ignition coil, the spark plug, and the electricity-supply resumption circuit are provided for each of the first through third cylinders.

Since the engine igniter of the third embodiment differs from that of the first embodiment only in the configuration and the processing of the signal processing unit 21 and the ECU 31 in relation to notification of the spark-discharge duration time Tc, the description will focus on portions which differ from those of the first embodiment.

First, the ECU 31 does not have an output terminal for outputting the spark duration signal Sc, and has output terminals for outputting to the signal processing unit 21 three signals; i.e., first through third reference ignition command signals IGSc1 to IGSc3.

By using a notification reference ignition command signal having a pulse width different from that of an ordinary reference ignition command signal, the ECU 31 communicates to the signal processing control circuit 23 the spark-discharge duration time Tc, which is set in accordance with operation conditions of the internal combustion engine. For example, for each value of the spark-discharge duration time Tc, the number of continuously output notification reference ignition command signals corresponding thereto is determined and stored in the form of a map; and the notification reference ignition command signal is output a plurality of times corresponding to a value of the spark-discharge duration time Tc, which is set in accordance with operation conditions of the internal combustion engine.

Notably, the number of continuously output notification reference ignition command signals is not counted on a cylinder-by-cylinder basis. For example, when the notification reference ignition command signal is to be output three times continuously, the first through third reference ignition command signals IGSc1 to IGSc3 may be output successively in such manner that the first through third reference ignition command signals IGSc1 to IGSc3 have a pulse width different from the ordinary pulse width and thus serve as notification reference ignition command signals.

Since operation conditions of the internal combustion engine do not change between periods of spark discharge generated at intervals of several milliseconds, the spark-discharge duration time Tc is communicated once during performance of a plurality of combustion cycles (e.g., once every 100 combustion cycles).

The signal processing unit 21 includes a signal processing control circuit 23 constituted by a microcomputer; a first IG signal input circuit 25, a second IG signal input circuit 125, and a third IG signal input circuit 225, which form signal paths for respectively inputting the first through third reference ignition command signals IGSc1 to IGSc3 to the signal processing control circuit 23.

In the third embodiment, since the spark-discharge duration time Tc is communicated by use of the reference ignition command signals, the first IG signal input circuit 25, the second IG signal input circuit 125, and the third IG signal input circuit 225 play the role of the spark-duration-signal input circuit used in the first embodiment.

Next, spark-discharge duration time read processing performed by the signal processing control circuit 23 will be described. The spark-discharge duration time read processing is started upon startup of the internal combustion engine. The spark-discharge duration time read processing is not performed on a cylinder-by-cylinder basis but is performed commonly among the cylinders in order to read a spark-discharge duration time common among the cylinders.

When the spark-discharge duration time read processing is started, on the basis of pulse width, a judgment is made as to whether a signal obtained through logical addition (OR) of input reference ignition command signals is a notification reference ignition command signal. When the signal obtained through logical addition is judged to be a notification reference ignition command signal, the notification reference ignition command signals are counted until an ordinary reference ignition command signal is input.

When an ordinary reference ignition command signal is input, and the number of continuously input notification reference ignition command signals becomes definitely known, on the basis of the relationship between spark-discharge duration time Tc and the number of continuously input notification reference ignition command signals set in the above-described map provided in the ECU 31, a spark-discharge duration time Tc corresponding to the number of continuously input notification reference ignition command signals is detected.

Subsequently, the judgment as to whether a signal obtained through logical addition (OR) of input reference ignition command signals is a notification reference ignition command signal is performed again on the basis of pulse width. By repeating the above-described series of processing, the spark-discharge duration time read processing reads a new spark-discharge duration time Tc output from the ECU 31 and updates the old spark-discharge duration time Tc. This updating operation is performed whenever a new spark-discharge duration time Tc is read every 100 combustion cycles.

Figure 6:
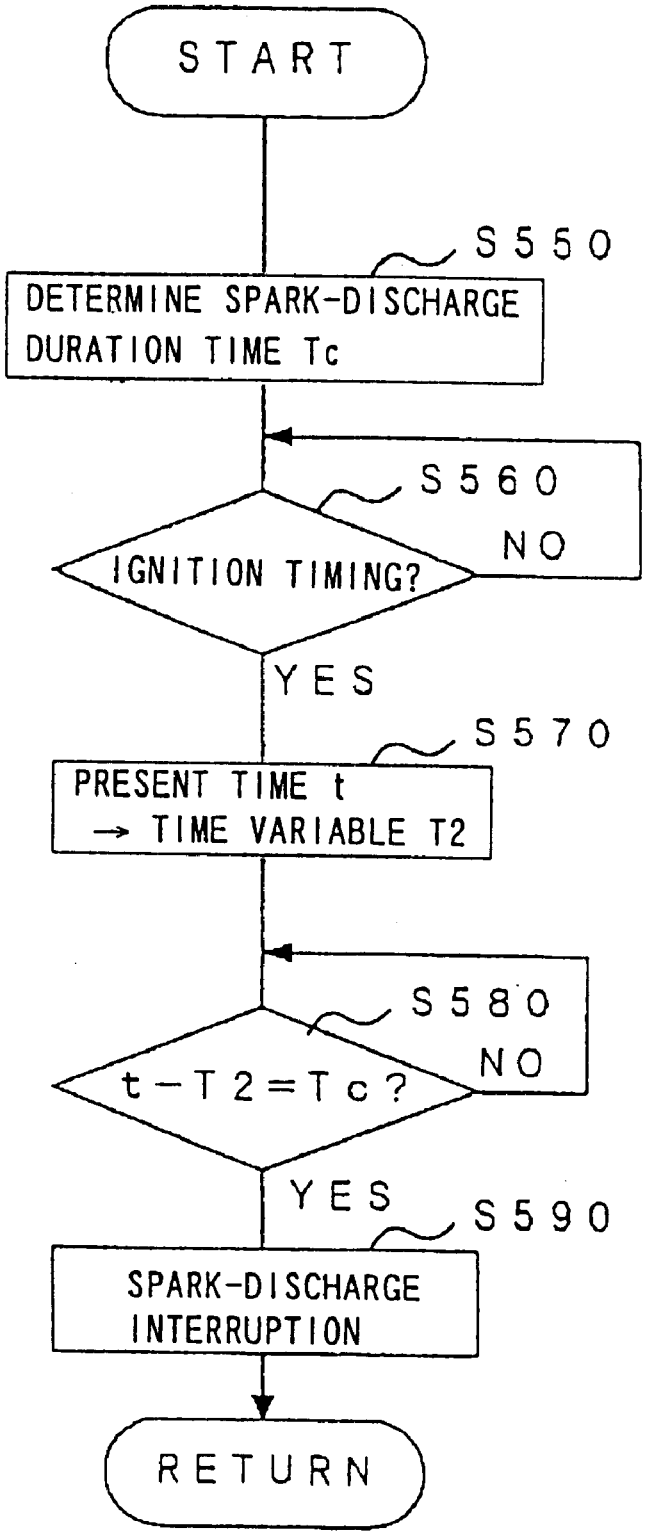
FIG. 6 is a flowchart showing the details of spark-discharge interruption control processing.

The signal processing control circuit 23 of the third embodiment performs spark-discharged interruption control processing which differs in processing in step S550 from the spark-discharged interruption control processing of the first embodiment shown in FIG. 6. That is, in step S550 of the spark-discharged interruption control processing performed in the present embodiment, the spark-discharge duration time Tc is not read from the spark duration signal Sc, but the spark-discharge duration time Tc updated by the spark-discharge duration time read processing is read for use in subsequent combustion cycles. In subsequent spark-discharged interruption control processing, processing identical with that in steps S560 to S590 of the first embodiment is performed. Thus, when the spark-discharge duration time Tc has elapsed after the corresponding ignition timing, the spark-discharged interruption is performed in order to interrupt spark discharge.

Notably, as in the first embodiment, the spark-discharged interruption control processing of the third embodiment is performed once during each combustion cycle for each cylinder. After startup of the internal combustion engine, the spark-discharged interruption control processing is started when the reference ignition command signal IG for each cylinder has risen (from low level to high level).

Figure 9:
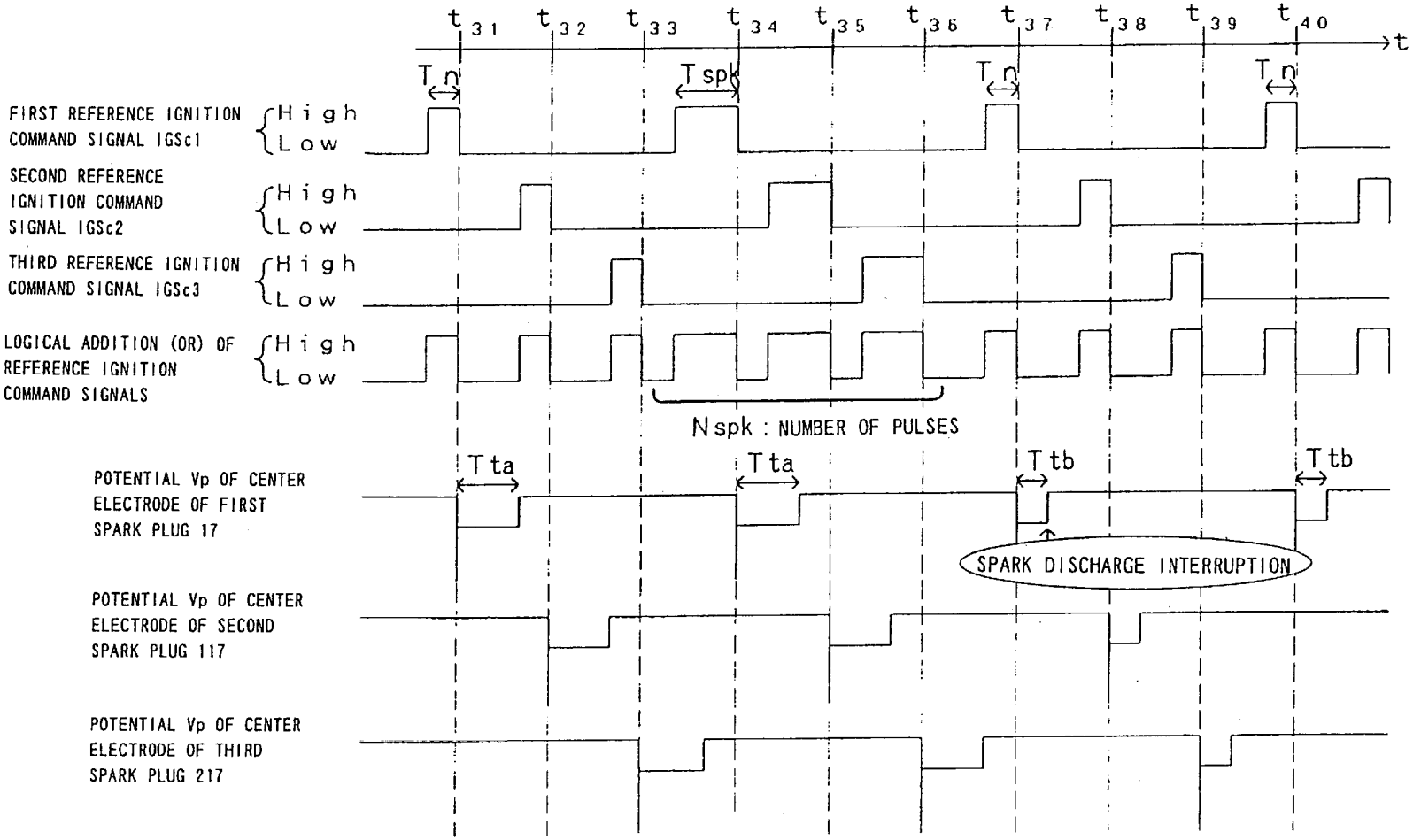
FIG. 9 is a time chart showing the states of respective portions of the engine igniter according to the third embodiment.

FIG. 9 shows a time chart representing variations with time in the reference ignition command signals for the first through third cylinders, the signal obtained through logical addition (OR) of the reference ignition command signals for the respective cylinders, and the potentials of the center electrodes of the spark plugs 17 for the respective cylinders.

As shown in FIG. 9, the signal obtained through logical addition (OR) of the reference ignition command signals which have been output from the ECU 31 during the period from t33 to t36 serve as notification reference ignition command signals having a pulse width Tspk greater than the pulse width Tn of an ordinary reference ignition command signal and represents that the spark-discharge duration time Tc is to be updated. Therefore, spark discharge generated after t37 is interrupted upon elapse of a spark-discharge duration time Ttb, which is shorter than a spark-discharge duration time Tta after which the spark discharge ends naturally. That is, spark discharge generated after t37 is interrupted upon elapse of the spark-discharge duration time Ttb after the corresponding ignition timing until the spark-discharge duration time Tc is updated.

Next, an engine igniter will be described according to a fourth embodiment in which the signal processing control circuit 23 has a reduced number of input terminals as compared with the third embodiment. Since the fourth embodiment differs from the third embodiment only in the configuration of the signal processing unit 21, the description will focus on portions which differ from those of the third embodiment.

Figure 10:
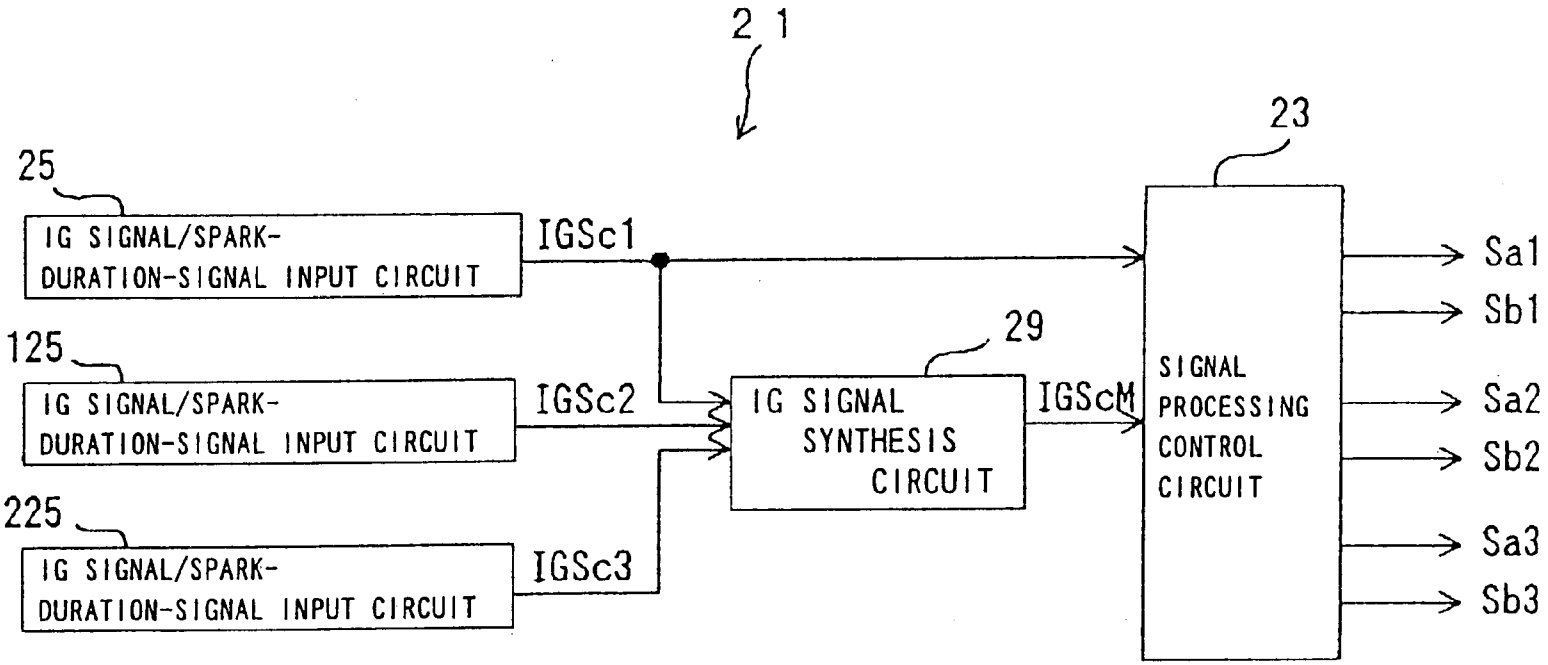
FIG. 10 is a diagram showing the configuration of the signal processing unit 21 of an engine igniter according to a fourth embodiment of the invention.

As shown in FIG. 10, the signal processing unit 21 of the fourth embodiment includes an IG signal synthesis circuit 29, in addition to the signal processing control circuit 23, the first IG signal input circuit 25, the second IG signal input circuit 125, and the third IG signal input circuit 225.

As in the case of the third embodiment, in the fourth embodiment, since the spark-discharge duration time Tc is communicated using reference ignition command signals, the first IG signal input circuit 25, the second IG signal input circuit 125, and the third IG signal input circuit 225 play the role of the spark-duration-signal input circuit.

The IG signal synthesis circuit 29 receives the first through third reference ignition command signals IGSc1 to IGSc3 from the first IG signal input circuit 25, the second IG signal input circuit 125, and the third IG signal input circuit 225, respectively. Further, the IG signal synthesis circuit 29 outputs a synthesized ignition command signal IGScM to the signal processing control circuit 23.

The IG signal synthesis circuit 29 sets the level of the synthesized ignition command signal IGScM to high when at least one of the three reference ignition command signals is at high level, and sets the level of the synthesized ignition command signal IGScM to low when all the three reference ignition command signals are at low level.

The signal processing control circuit 23 receives two signal transmitted from the ECU 31; i.e., the first reference ignition command signal IGSc1 and the synthesized ignition command signal IGScM. Therefore, when the ECU 31 changes the level of the first reference ignition command signal IGSc1 in order to generate spark discharge in the first cylinder, the level of the synthesized ignition command signal IGScM changes together with the level of the first reference ignition command signal IGSc1. By contrast, when the ECU 31 changes the level of the second reference ignition command signal IGSc2 or the third reference ignition command signal IGSc3 in order to generate spark discharge in the second or third cylinder, only the level of the synthesized ignition command signal IGScM changes.

In the internal combustion engine for which the engine igniter of the present embodiment is provided, spark discharge is always generated in the first cylinder, in the second cylinder, and in the third cylinder, in this sequence. Therefore, when the level of the first reference ignition command signal IGSc1 and the level of the synthesized ignition command signal IGScM change concurrently, the signal processing control circuit 23 detects this change as a reference ignition command signal for the first cylinder, and changes the level of the first ignition command signal Sa1 in accordance with the level of the synthesized ignition command signal IGScM. Subsequently, when the level of the synthesized ignition command signal IGScM changes, the signal processing control circuit 23 detects this change as a reference ignition command signal for the second cylinder, and changes the level of the second ignition command signal Sa2 in accordance with the level of the synthesized ignition command signal IGScM. Subsequently, when the level of the synthesized ignition command signal IGScM changes, the signal processing control circuit 23 detects this change as a reference ignition command signal for the third cylinder, and changes the level of the third ignition command signal Sa3 in accordance with the level of the synthesized ignition command signal IGScM.

That is, the signal processing control circuit 23 of the fourth embodiment uses the first reference ignition command signal IGSc1 for the first cylinder as a reference, and outputs an ignition command signal for the first cylinder, an ignition command signal for the second cylinder, and an ignition command signal for the third cylinder, in this sequence, each time the synthesized ignition command signal IGScM is input to the signal processing control circuit 23, to thereby generate spark discharge at proper timing in each of the cylinders.

Since the engine igniter of the fourth embodiment eliminates the necessity of inputting to the signal processing control circuit 23 reference ignition command signals for all the cylinders, the engine igniter of the fourth embodiment can operate the internal combustion engine by using a signal processing control circuit having fewer input terminals as compared with the third embodiment.

Further, the signal processing control circuit 23 judges the pulse width of the synthesized ignition command signal IGScM to thereby count the number of continuously output notification reference ignition command signals, to thereby read the spark-discharge duration time Tc. Since the notification reference ignition command signal is detected from the synthesized ignition command signal IGScM, the processing which is performed within the signal processing control circuit 23 in order to obtain the result of logical addition (OR) of the reference ignition command signals for three cylinders can be omitted. Thus, an increase in processing load of the signal processing control circuit 23 can be suppressed.

Accordingly, the engine igniter of the fourth embodiment reduces the number of input terminals of the signal processing control circuit provided in the signal processing unit in order to reduce the area occupied by the signal processing control circuit, to thereby increase packaging density. In addition, an increase in processing load of the signal processing control circuit can be suppressed.

Notably, in the engine igniter of the fourth embodiment, the first IG signal input circuit 25 corresponds to the first signal path; and the IG signal synthesis circuit 29 corresponds to the second signal path.

Figure 11:
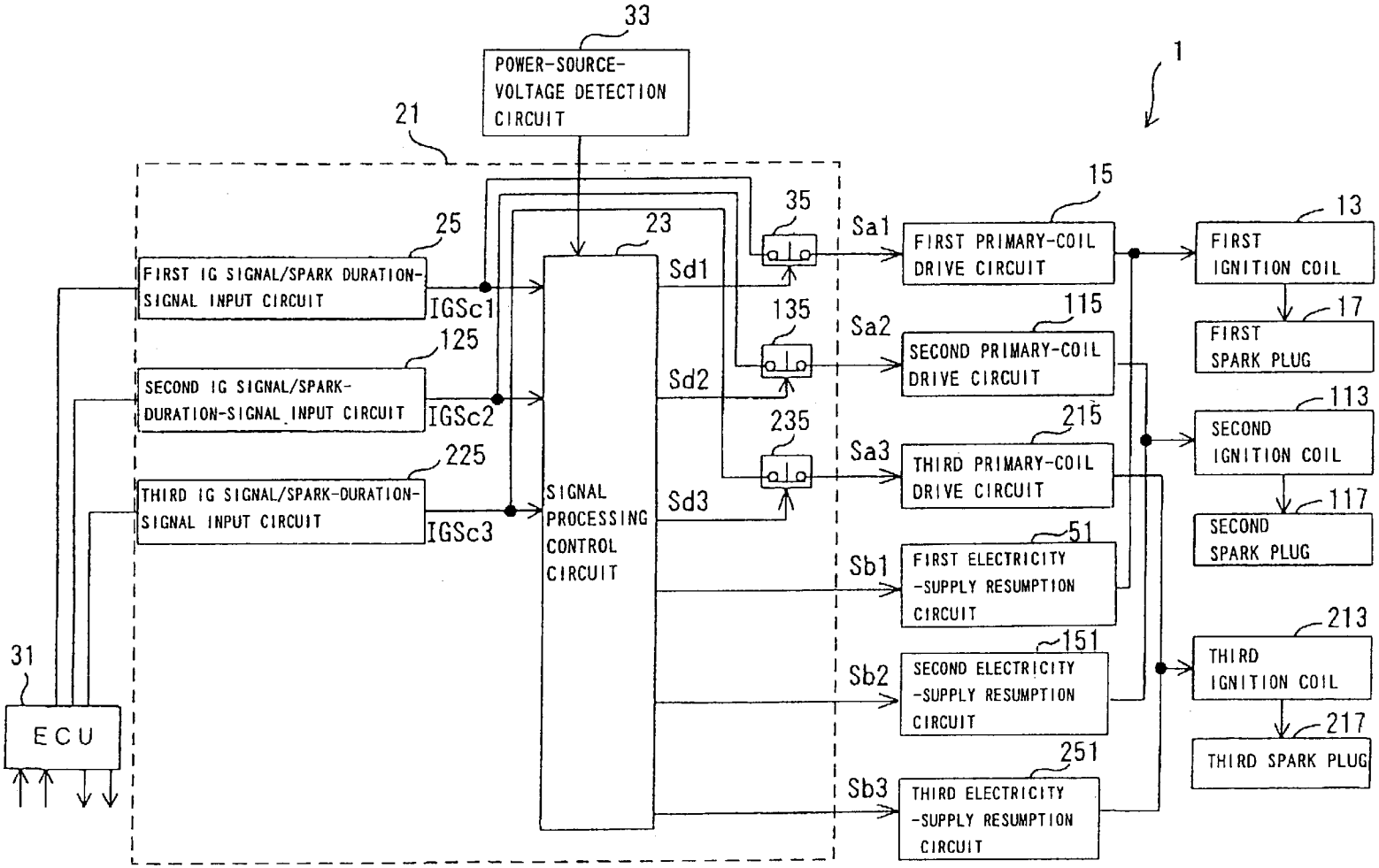
FIG. 11 is a diagram schematically showing the configuration of an engine igniter according to a fifth embodiment of the invention.

Next, an engine igniter will be described according to the fifth embodiment, which has a signal processing unit 21 configured to output the reference ignition command signals received from the ECU 31 directly to the primary-coil drive circuit. FIG. 11 is a diagram schematically showing the configuration of the engine igniter according to the fifth embodiment.

As shown in FIG. 11, the engine igniter 1 according to the fifth embodiment includes the above-described signal processing unit 21, a power-source-voltage detection circuit 33, primary-coil drive circuits, ignition coils, spark plugs, and electricity-supply resumption circuits. The engine igniter 1 further includes an unillustrated DC power source unit 11 and the above-described ECU 31. Notably, the primary-coil drive circuit, the ignition coil, the spark plug, and the electricity-supply resumption circuit are provided for each of the first through third cylinders.

Since the engine igniter of the fifth embodiment differs from that of the third embodiment only in the configuration and processing of the signal processing unit 21, the description will focus on portions which differ from those of the third embodiment.

The signal processing unit 21 includes a signal processing control circuit 23 constituted by a microcomputer; a first IG signal input circuit 25, a second IG signal input circuit 125, and a third IG signal input circuit 225, which form signal paths for respectively inputting the first through third reference ignition command signals IGSc1 to IGSc3 to the signal processing control circuit 23; and a first ignition-command-signal interruption circuit 35, a second ignition-command-signal interruption circuit 135, and a third ignition-command-signal interruption circuit 235 for breaking signal paths used for respectively outputting the first through third reference ignition command signals IGSc1 to IGSc3 directly to the first primary-coil drive circuit 15, the second primary-coil drive circuit 115, and the third primary-coil drive circuit 215.

For each cylinder, the signal processing unit 21 includes a signal path for outputting directly to the corresponding primary-coil drive circuit the reference ignition command signal received from the corresponding IG signal input circuit.

The first ignition-command-signal interruption circuit 35 is provided in the signal path extending from the first IG signal input circuit 25 of the signal processing unit 21 to the first primary-coil drive circuit 15. When no external command signal is input to the first ignition-command-signal interruption circuit 35, the first ignition-command-signal interruption circuit 35 maintains the continuity of the signal path extending from the first IG signal input circuit 25 to the first primary-coil drive circuit 15 (a connected state). When an external command signal is input to the first ignition-command-signal interruption circuit 35, the first ignition-command-signal interruption circuit 35 breaks the signal path extending from the first IG signal input circuit 25 to the first primary-coil drive circuit 15 (a disconnected state). The first electricity-supply start delay signal Sd1 output from the signal processing control circuit 23 is input to the first ignition-command-signal interruption circuit 35. The first ignition-command-signal interruption circuit 35 is brought into the connected state when the level of the first electricity-supply start delay signal Sd1 is low, and is brought into the disconnected state when the level of the first electricity-supply start delay signal Sd1 is high.

Further, the second ignition-command-signal interruption circuit 135 is provided in the signal path for supplying the second reference ignition command signal IGSc2 from the second IG signal input circuit 125 to the second primary-coil drive circuit 115; and the third ignition-command-signal interruption circuit 235 is provided in the signal path for supplying the third reference ignition command signal IGSc3 from the third IG signal input circuit 225 to the third primary-coil drive circuit 215. The second electricity-supply start delay signal Sd2 output from the signal processing control circuit 23 is input to the second ignition-command-signal interruption circuit 135; and the third electricity-supply start delay signal Sd3 output from the signal processing control circuit 23 is input to the third ignition-command-signal interruption circuit 235. As a result, each of the second and third ignition-command-signal interruption circuits 135 and 235 comes into a connected or disconnected state in accordance with the corresponding electricity-supply start delay signal.

As in the case of the third embodiment, the signal processing control circuit 23 reads the spark-discharge duration time Tc from notification ignition command signals having a pulse width different from an ordinary pulse width, among the first through third reference ignition command signals IGSc1 to IGSc3. Subsequently, on the basis of the thus read spark-discharge duration time Tc, the signal processing control circuit 23 outputs the first spark-discharge interruption command signal Sb1 to the electricity-supply resumption circuit 51 corresponding to the first cylinder. Further, the signal processing control circuit 23 outputs the second and third spark-discharge interruption command signals Sb2 and Sb3 to the electricity-supply resumption circuits corresponding to the second and third cylinders. In this manner, the signal processing control circuit 23 interrupts spark discharge in the respective cylinders by use of the spark-discharge duration time Tc communicated from the ECU 31.

The signal processing control circuit 23 does not output ignition command signals (Sa1, Sa2, and Sa3). The signals output from the first, second, and third ignition-command-signal interruption circuit 35, 135, and 235 to the respective primary-coil drive circuits serve as the first through third ignition command signals Sa1, Sa2 and Sa3, respectively.

By outputting the first through third electricity-supply start delay signals Sd1 to Sd3, the signal processing control circuit 23 can maintain the first through third ignition command signals Sa1, Sa2 and Sa3 at a low level. That is, the signal processing control circuit 23 can prevent the supply of primary current from starting when the corresponding reference ignition command signal is input from the ECU 31 and can delay the start of the supply of primary current.

Next, the electricity-supply-start timing delay control processing performed by the signal processing control circuit 23 will be described.

Figure 5:
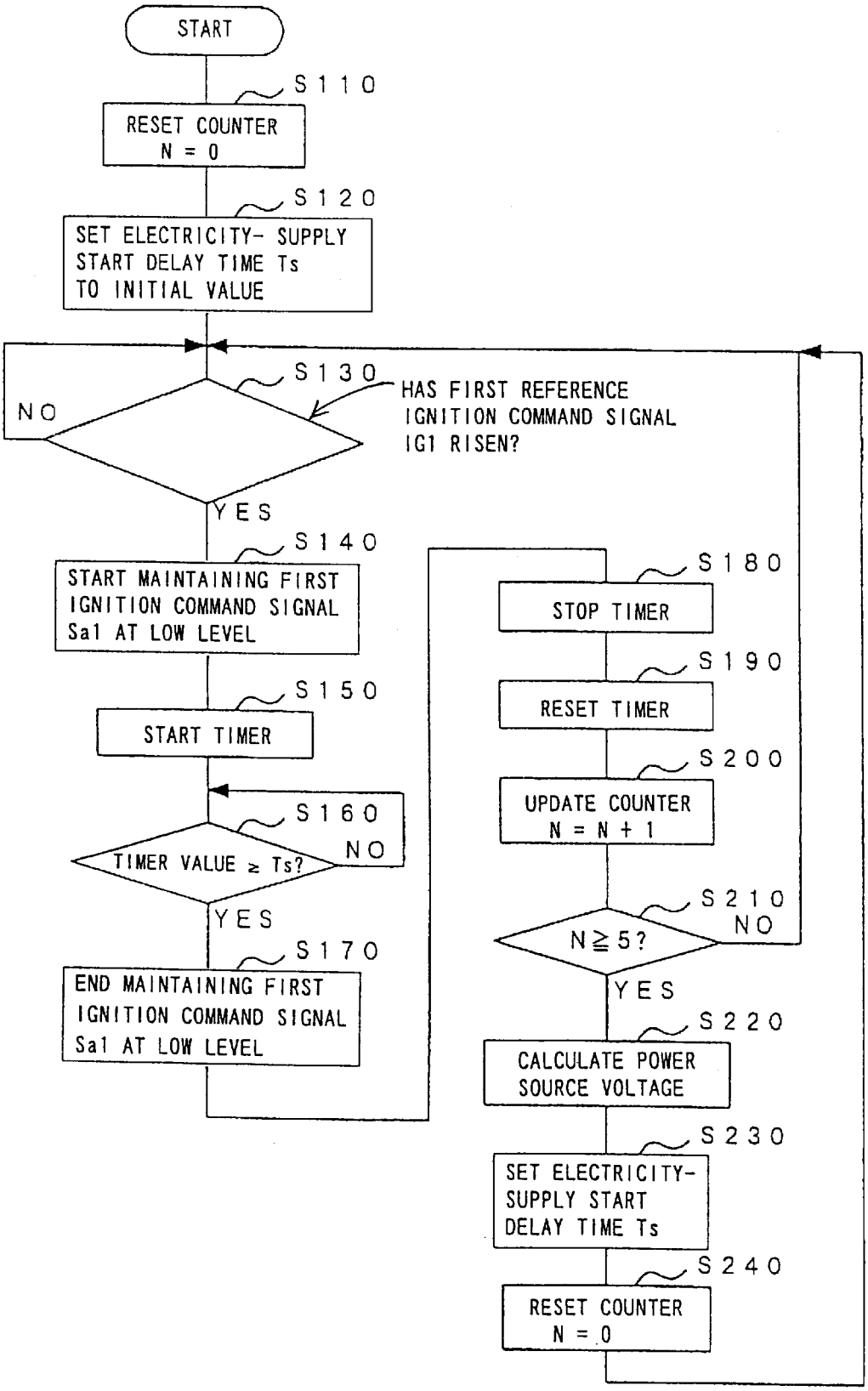
FIG. 5 is a flowchart showing the details of electricity-supply-start timing delay control processing.

The electricity-supply-start timing delay control processing of the fifth embodiment is substantially the same as that in the first embodiment shown in FIG. 5, except for the processing in steps S140 and S170. Therefore, only the portions that differ from those of the first embodiment will be described.

In step S140 of the fifth embodiment, the level of the first electricity-supply start delay signal Sd1 is set high in order to bring the first ignition-command-signal interruption circuit 35 into a disconnected state, to thereby prevent the first reference ignition command signal IGSc1 from being input to the first primary-coil drive circuit 15. That is, by preventing the first ignition command signal Sa1 from being controlled by the first reference ignition command signal IGSc1, the first primary-coil drive circuit 15 is maintained in an OFF state, regardless of the command from the ECU 31, to thereby prohibit the supply of primary current.

When the electricity-supply-start delay time Ts has elapsed, in step S170, the level of the first electricity-supply start delay signal Sd1 is set low in order to bring the first ignition-command-signal interruption circuit 35 into a connected state, to thereby permit the first reference ignition command signal IGSc1 to be input to the first primary-coil drive circuit 15. That is, by permitting the first ignition command signal Sa1 to be controlled by the first reference ignition command signal IGSc1, the first primary-coil drive circuit 15 is maintained in an ON state, to thereby start the supply of primary current.

As in the first embodiment, the electricity-supply-start timing delay control processing of the fifth embodiment controls the timing for starting supply of primary current i1 on the basis of a predetermined initial value of the electricity-supply-start delay time Ts immediately after startup of the internal combustion engine; subsequently detects power source voltage every five combustion cycles of the cylinder; and updates the electricity-supply-start delay time Ts on the basis of the detected power source voltage. The electricity-supply-start timing delay processing delays the timing for starting supply of electricity to the primary winding L1, on the basis of the latest value of the electricity-supply-start delay time Ts.

Figure 12:
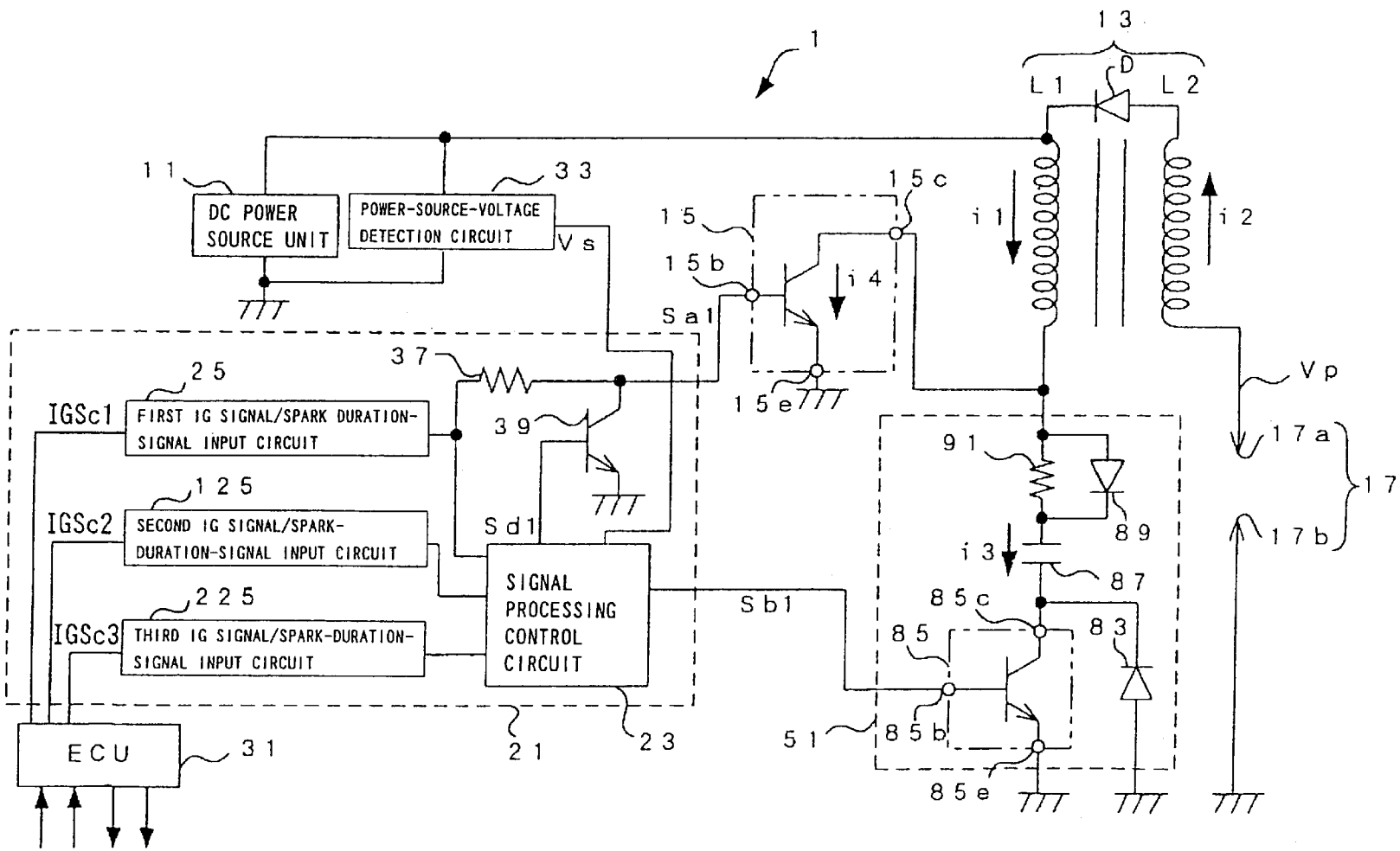
FIG. 12 is a diagram showing the configuration of a portion of the engine igniter according to the fifth embodiment corresponding to the first cylinder.

FIG. 12 is a block diagram showing a configuration of a portion of the engine igniter of the fifth embodiment corresponding to the first cylinder.

As shown in FIG. 12, the engine igniter 1 of the fifth embodiment includes a DC power source unit 11; an ignition coil 13; a main control transistor 15; a spark plug 17; an electricity-supply resumption circuit 51; a signal processing unit 21; an electronic control unit (hereinafter referred to as an "ECU") 31; and a power-source-voltage detection circuit 33.

The ignition coil 13 corresponds to the first ignition coil 13 in FIG. 11; the main control transistor 15 corresponds to the first primary-coil drive circuit 15 in FIG. 11; the spark plug 17 corresponds to the first spark plug 17 in FIG. 11; and the electricity-supply resumption circuit 51 corresponds to the first electricity-supply resumption circuit 51 in FIG. 11. Ignition coils, primary-coil drive circuits, spark plugs, and electricity-supply resumption circuits for the second and third cylinders have the same configurations as those of the ignition coil 13, the main control transistor 15, the spark plug 17, and the electricity-supply resumption circuit 51 shown in FIG. 12.

The signal processing unit 21 includes a signal processing control circuit 23, which is constituted by a microcomputer; a first IG signal input circuit 25; a second IG signal input circuit 125; a third IG signal input circuit 225; an npn-type signal-interruption transistor 39; and a resistor 37. The signal-interruption transistor 39 and the resistor 37 serve as the first ignition-command-signal interruption circuit 35 shown in FIG. 11. Although not shown in FIG. 12, the signal processing unit 21 includes signal-interruption transistors and resistors for the second and third cylinders.

The first IG signal input circuit 25 receives the first reference ignition command signal IGSc1 from the ECU 31 and outputs it to the main control transistor 15 via the resistor 37 and to the signal processing control circuit 23. The signal input from the resistor 37 to the main control transistor 15 will be referred to as a first ignition command signal Sa1.

The base of the signal-interruption transistor 39 is connected to the output terminal of the signal processing control circuit 23 from which the first electricity-supply start delay signal Sd1 is output; the emitter of the signal-interruption transistor 39 is grounded; and the collector of the signal-interruption transistor 39 is connected to a line extending from the resistor 37 to the base 15*b* of the main control transistor 15.

When the first electricity-supply start delay signal Sd1 input to the base of the signal-interruption transistor 39 is at low level (typically, ground potential), no base current flows into the signal-interruption transistor 39, and consequently, the signal-interruption transistor 39 enters an OFF state. At this time, the level of the first ignition command signal Sa1 input to the base 15*b* of the main control transistor 15 is determined on the basis of the level of the first reference ignition command signal IGSc1 output from the ECU 31. In other words, when the signal-interruption transistor 39 is in the OFF state, the main control transistor 15 is turned on and off in accordance with the first reference ignition command signal IGSc1 output from the ECU 31.

When the first electricity-supply start delay signal Sd1 is at high level (e.g., 5 V, which is voltage supplied from the constant voltage power source), base current flows into the signal-interruption transistor 39, and consequently, the signal-interruption transistor 39 enters an ON state. At this time, the first ignition command signal Sa1 is maintained at low level, and is not determined on the basis of the level of the first reference ignition command signal IGSc1 output from the ECU 31. In other words, when the signal-interruption transistor 39 is in the ON state, the main control transistor 15 is maintained OFF, irrespective of the first reference ignition command signal IGSc1 output from the ECU 31.

Therefore, when the level of the first electricity-supply start delay signal Sd1 output from the signal processing control circuit 23 is low, the main control transistor 15 is turned on and off in accordance with the command (the first reference ignition command signal IGSc1) output from the ECU 31. When the level of the first electricity-supply start delay signal Sd1 is high, the main control transistor 15 is in the OFF state at all times, irrespective of the level of the command (the first reference ignition command signal IGSc1) output from the ECU 31.

Figure 13:
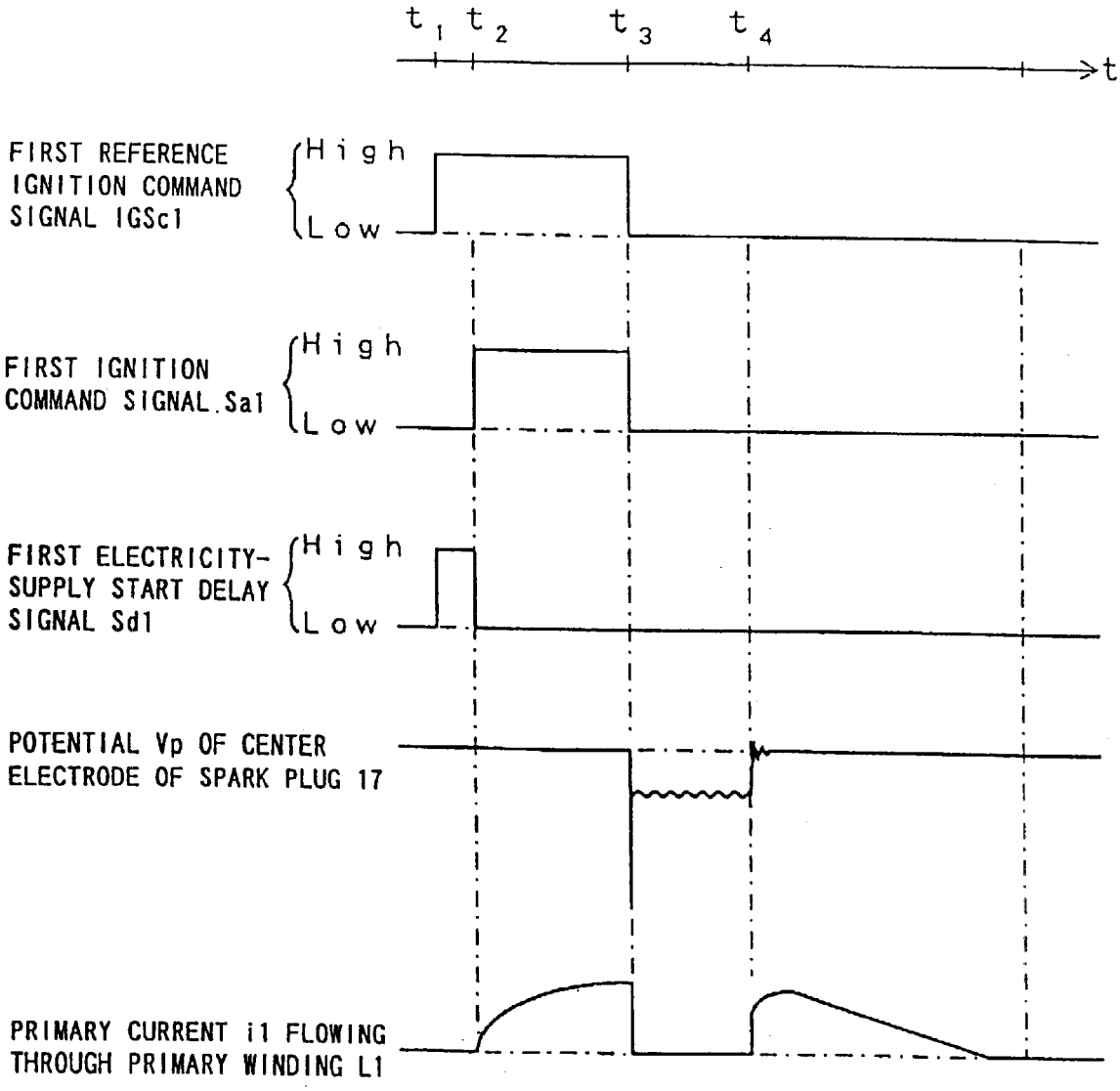
FIG. 13 is a time chart showing the states of respective portions of the engine igniter according to the fifth embodiment.

FIG. 13 shows a time chart representing variations with time in the first reference ignition command signal IGSc1, the first ignition command signal Sa1, the first electricity-supply start delay signal Sd1, the primary current i1, and the potential Vp of the center electrode 17*a* of the spark plug 17, all of which appear in the engine igniter of the fifth embodiment shown in FIG. 12.

The level of the first reference ignition command signal IGSc1 is switched from low to high at time t1 shown in FIG. 13. In synchronism with this, the level of the first electricity-supply start delay signal Sd1 is switched from low to high on the basis of the divided voltage Vs of the power source voltage detected by the power-source-voltage detection circuit 33. As a result, the first ignition command signal Sa1 is maintained at a low level, and therefore no primary current i1 flows through the primary winding L1. When the electricity-supply-start delay time has elapsed, at time t2, the level of the first electricity-supply start delay signal Sd1 is switched to low. As a result, the level of the first ignition command signal Sa1 is switched to high, and therefore the main control transistor 15 enters an ON state, with the result that the primary current i1 flows through the primary winding L1.

When time t3 serving as an ignition timing comes as a result of further passage of time, the level of the first reference ignition command signal IGSc1 is switched from high to low, and consequently the main control transistor 15 is turned off. Thus, supply of the primary current i1 to the primary winding L1 is interrupted, and a negative high voltage for ignition is applied to the center electrode 17*a* of the spark plug 17. As a result, the potential Vp of the center electrode 17*a* decreases abruptly, and thus, spark discharge is generated between the electrodes 17*a* and 17*b* of the spark plug 17. When a separately set spark-discharge duration time has elapsed, at time t4, the level of the first spark-discharge interruption command signal Sb1 (not illustrated in FIG. 13) becomes high, and consequently, spark discharge is interrupted.

As described above, in the fifth embodiment, even after the level of the first reference ignition command signal IGSc1 is changed to high, the primary current i1 does not flow, insofar as the level of the first electricity-supply start delay signal Sd1 is high. Therefore, the timing for starting the supply of primary current i1 can be delayed by means of the first electricity-supply start delay signal Sd1. As a result, in the engine igniter of the fifth embodiment, the actual primary current supply period (from time t2 to time t3) is shorter than the primary current supply period (from time t1 to time t3) set by the ECU 31.

The signal processing control circuit 23 merely controls the timing for starting the supply of electricity to the primary winding L1 and does not change the ignition timing; the ignition timing is determined by the ECU 31. Therefore, provision of the signal processing control circuit 23 does not affect the ignition timing.

As described above, in the engine igniter of the fifth embodiment, the timing for supplying electricity to the primary winding L1 is delayed in accordance with the magnitude of the power source voltage, whereby the magnetic flux energy accumulated in the ignition coil 13 can be maintained at a substantially constant level even when the power source voltage varies. Therefore, the engine igniter of the present embodiment can prevent the magnetic flux energy from excessively accumulating in the ignition coil 13 due to influence of variation in the power source voltage. As a result, it is possible to prevent supply to capacitor 87 of charge exceeding an allowable amount, which supply would otherwise have been effected at the time of interruption of spark discharge.

Moreover, in an event that the signal processing control circuit 23 becomes unable to output the first electricity-supply start delay signal Sd1 due to a certain cause, the signal-interruption transistor 39 enters an OFF state. Therefore, the main control transistor 15 is controlled by the ECU 31 in order to control supply and interruption of primary current i1, thereby enabling the operation of the internal combustion engine to continue.

Although embodiments of the present invention have been described above, the present invention is not limited thereto and may be practiced in various forms.

For example, the DC power source unit is not limited to a DC power source unit in which AC voltage from a commercial power source is converted into DC voltage; the engine igniter of the present invention can be practiced by use of a battery which outputs charged electrical energy in the form of DC voltage.

In the above-described embodiments, power source voltage is detected every five combustion cycles in order to update the electricity-supply-start delay time Ts. However, this updating operation may be performed every ten combustion cycles, and the updating interval may be preferably set in accordance with the frequency of variation of the power source voltage.

The internal combustion engine is not limited to a gas engine using a gaseous fuel; the engine igniter of the present invention may be applied to an internal combustion engine using a liquid fuel such as gasoline.

Some of the above-described embodiments use a method for communicating a spark-discharge duration time by means of the number of continuously output notification reference ignition command signals. However, alternatively, the following method may be employed. The relationship between pulse width and spark-discharge duration time Tc is previously stored in the form of a map; and a spark-discharge duration time is communicated by means of the pulse width of a single notification reference ignition command signal.

It should further be apparent to those skilled in the art that various changes in forming detail of the invention as shown and described above may be made. It is intended that such changes be included within the spirit and scope of the claims appended hereto.

This application is based on Japanese Patent Application No. 2000-332505 filed Oct. 31, 2000, the disclosure of which is incorporated herein by reference in its entirety.

What is claimed is:

1. An ignition apparatus for an internal combustion engine comprising:

a DC power source unit;

an ignition coil having a primary winding through which primary current flows upon application to the primary winding of power source voltage from the DC power source unit, and a secondary winding which forms a closed loop in cooperation with a spark plug attached to the internal combustion engine;

switching means connected in series to the primary winding and adapted to interrupt and resume the primary current flowing through the primary winding; and ignition control means for outputting an ignition command signal for controlling ignition timing, the ignition command signal causing the switching means to interrupt and resume the primary current flowing through the primary winding in order to generate at the secondary winding high voltage for ignition to thereby cause the spark plug to generate spark discharge, characterized in that the ignition apparatus further comprises:

spark-discharge duration time setting means for setting a spark-discharge duration time on the basis of operation conditions of the internal combustion engine, the spark-discharge duration time representing a period during which spark discharge of the spark plug is to be maintained;

spark-discharge interruption control means for outputting a spark-discharge interruption command signal for controlling the spark-discharge duration time;

a spark-discharge interruption circuit for resuming, after generation of spark discharge by the spark plug, supply of the primary current to the primary winding in accordance with the spark-discharge interruption command signal so as to interrupt the spark discharge; and energy control means for maintaining at a substantially constant level magnetic flux energy which accumulates in the ignition coil by supply of electricity to the primary winding by means of the ignition control means.

2. The ignition apparatus for an internal combustion engine as claimed in claim 1, wherein the spark-discharge interruption circuit has an electricity-supply resumption circuit connected in parallel to the switching means, the electricity-supply resumption circuit including:

spark-discharge interruption switching means for resuming supply of the primary current to the primary winding in accordance with the spark-discharge interruption command signal; and current adjustment means connected in series to the spark-discharge interruption switching means and adapted to reduce the primary current flowing through the primary winding, after resumption of supply of the primary current to the primary winding, so as to prevent the spark plug from generating spark discharge.

3. The ignition apparatus for an internal combustion engine as claimed in claim 1, wherein the energy control means includes:

electricity-supply-start timing delay means for detecting power source voltage output from the DC power source unit, for setting, on the basis of the power source voltage, an electricity-supply-start delay time representing a time by which start of supply of electricity to the primary winding is to be delayed, and for delaying by the electricity-supply-start delay time the timing at which the ignition control means starts supply of electricity to the primary winding.

4. The ignition apparatus for an internal combustion engine as claimed in claim 2, wherein the energy control means includes:

electricity-supply-start timing delay means for detecting power source voltage output from the DC power source unit, for setting, on the basis of the power source voltage, an electricity-supply-start delay time representing a time by which start of supply of electricity to the primary winding is to be delayed, and for delaying by the electricity-supply-start delay time the timing at which the ignition control means starts supply of electricity to the primary winding.

5. The ignition apparatus as claimed in claim 3, for use with an internal combustion engine having a plurality of cylinders, wherein the ignition coil, the switching means, and the spark-discharge interruption circuit are provided for each of spark plugs attached to the respective cylinders; and the ignition control means comprises:

a main controller including the spark-discharge duration time setting means, the main controller setting an ignition timing and a spark-discharge duration time for each cylinder on the basis of operation conditions of the internal combustion engine, and generating a reference ignition command signal corresponding to the ignition timing, and a signal processing unit including the electricity-supply-start timing delay means and the spark-discharge interruption control means, the signal processing unit receiving the reference ignition command signal output from the main controller and outputting to the switching means an ignition command signal which is delayed from the reference ignition command signal by the electricity-supply-start delay time, and generating, on the basis of the spark-discharge duration time set by the main controller, a spark-discharge interruption command signal to be output to the spark-discharge interruption circuit.

6. The ignition apparatus as claimed in claim 4, for use with an internal combustion engine having a plurality of cylinders, wherein the ignition coil, the switching means, and the spark-discharge interruption circuit are provided for each of spark plugs attached to the respective cylinders; and the ignition control means comprises:

a main controller including the spark-discharge duration time setting means, the main controller setting an ignition timing and a spark-discharge duration time for each cylinder on the basis of operation conditions of the internal combustion engine, and generating a reference ignition command signal corresponding to the ignition timing, and a signal processing unit including the electricity-supply-start timing delay means and the spark-discharge interruption control means, the signal processing unit receiving the reference ignition command signal output from the main controller and outputting to the switching means an ignition command signal which is delayed from the reference ignition command signal by the electricity-supply-start delay time, and generating, on the basis of the spark-discharge duration time set by the main controller, a spark-discharge interruption command signal to be output to the spark-discharge interruption circuit.

7. The ignition apparatus for an internal combustion engine as claimed in claim 5, wherein in order to communicate to the signal processing unit the spark-discharge duration time set by the spark-discharge duration time setting means, while maintaining the form of a portion of the reference ignition command signal used to communicate an ignition timing, said main controller including means for changing the form of another portion of the reference ignition command signal in order to include information representing the spark-discharge duration time; and said signal processing unit including means for reading the spark-discharge duration time from the reference ignition command signal output from the main controller and generating the spark-discharge interruption command signal on the basis of the spark-discharge duration time.

8. The ignition apparatus for an internal combustion engine as claimed in claim 6, wherein in order to communicate to the signal processing unit the spark-discharge duration time set by the spark-discharge duration time setting means, while maintaining the form of a portion of the reference ignition command signal used to communicate an ignition timing, said main controller including means for changing the form of another portion of the reference ignition command signal in order to include information representing the spark-discharge duration time; and said signal processing unit including means for reading the spark-discharge duration time from the reference ignition command signal output from the main controller and generating the spark-discharge interruption command signal on the basis of the spark-discharge duration time.

9. The ignition apparatus for an internal combustion engine as claimed in claim 5, wherein the signal processing unit comprises:

signal processing control means for executing at least the processing of the spark-discharge interruption control means and the processing of the electricity-supply-start timing delay means;

a first signal path for supplying to the signal processing control means at least one of the reference ignition command signals for the respective cylinders output from the main controller; and a second signal path for supplying to the signal processing control means a synthesized ignition command signal obtained by synthesis of all the reference ignition command signals output from the main controller, wherein the signal processing control means using, as a reference, a time at which the reference ignition command signal is input from the first signal path, and outputs ignition command signals for the respective cylinders in a predetermined sequence such that one ignition command signal is output every time the synthesized ignition command signal is input from the second signal path.

10. The ignition apparatus for an internal combustion engine as claimed in claim 6, wherein the signal processing unit comprises:

signal processing control means for executing at least the processing of the spark-discharge interruption control means and the processing of the electricity-supply-start timing delay means;

a first signal path for supplying to the signal processing control means at least one of the reference ignition command signals for the respective cylinders output from the main controller; and a second signal path for supplying to the signal processing control means a synthesized ignition command signal obtained by synthesis of all the reference ignition command signals output from the main controller, wherein the signal processing control means using, as a reference, a time at which the reference ignition command signal is input from the first signal path, and outputs ignition command signals for the respective cylinders in a predetermined sequence such that one ignition command signal is output every time the synthesized ignition command signal is input from the second signal path.

11. The ignition apparatus for an internal combustion engine as claimed in claim 1, wherein the internal combustion engine is a gas engine using a gaseous fuel.

* * * * *